US009829839B2

(12) United States Patent
Ando et al.

(10) Patent No.: US 9,829,839 B2
(45) Date of Patent: Nov. 28, 2017

(54) IMAGE HEATING APPARATUS HAVING AN ELECTRIC POWER SHUT-OFF MEMBER, THERMAL FUSE, OR THERMAL SWITCH OPERABLE IN RESPONSE TO AN ABNORMAL TEMPERATURE RISE

(71) Applicant: CANON KABUSHIKI KAISHA, Tokyo (JP)

(72) Inventors: Atsutoshi Ando, Yokohama (JP); Takashi Narahara, Mishima (JP); Toru Imaizumi, Kawasaki (JP); Yasuhito Minamishima, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/430,034

(22) PCT Filed: Nov. 21, 2013

(86) PCT No.: PCT/JP2013/081982
§ 371 (c)(1),
(2) Date: Mar. 20, 2015

(87) PCT Pub. No.: WO2014/081045
PCT Pub. Date: May 30, 2014

(65) Prior Publication Data

US 2015/0227091 A1 Aug. 13, 2015

(30) Foreign Application Priority Data

Nov. 21, 2012 (JP) ..... 2012-255276

(51) Int. Cl.
*G03G 15/20* (2006.01)
*G03G 15/00* (2006.01)

(52) U.S. Cl.
CPC ..... *G03G 15/205* (2013.01); *G03G 15/2046* (2013.01); *G03G 15/2053* (2013.01); *G03G 15/55* (2013.01); *G03G 2215/2035* (2013.01)

(58) Field of Classification Search
CPC ..... G03G 15/205; G03G 15/2057
(Continued)

(56) References Cited

U.S. PATENT DOCUMENTS 5,732,318 A * 3/1998 Natsuhara ..... G03G 15/2064 219/216
6,084,208 A * 7/2000 Okuda ..... G03G 15/2064 219/216
(Continued)

FOREIGN PATENT DOCUMENTS

CN 1577163 A 2/2005
JP 09-297478 A 11/1997
(Continued)

OTHER PUBLICATIONS

International Search Report (PCT/ISA/210) dated Mar. 4, 2014, issued in PCT Application No. PCT/JP2013/081982, and Written Opinion of the International Searching Authority (PCT/ISA/237).
(Continued)

*Primary Examiner* — Walter L Lindsay, Jr.
*Assistant Examiner* — Philip Marcus T Fadul
(74) *Attorney, Agent, or Firm* — Fitzpatrick, Cella, Harper & Scinto

(57) ABSTRACT

An image heating apparatus heats a toner image formed on a recording material, and includes: a heater including a substrate and a heat generating resistor thereon for generating heat for heating the toner image, by electric power supply; an electric power shut-off member operable in response to an abnormal temperature rise of the heater to shut off the electric power supply; and a heat conduction
(Continued)

member having a thermal conductivity, in a direction of a thickness of the substrate, higher than that of the substrate. The contact area between the heat conduction member and the substrate is larger than the contact area between the heat conduction member and the electric power shut-off member.

33 Claims, 10 Drawing Sheets

(58) Field of Classification Search
USPC ..... 399/33
See application file for complete search history.

(56) References Cited

U.S. PATENT DOCUMENTS

| | | | | |
|---|---|---|---|---|
| 6,469,279 | B1 | 10/2002 | Ohtsuka | |
| 7,002,105 | B2 | 2/2006 | Suzumi | |
| 7,177,579 | B2 | 2/2007 | Uchida et al. | |
| 7,209,696 | B2 | 4/2007 | Umezawa et al. | |
| 7,389,079 | B2 | 6/2008 | Narahara et al. | |
| 7,428,390 | B2 | 9/2008 | Ando | |
| 7,512,370 | B2 | 3/2009 | Shimizu et al. | |
| 7,570,895 | B2 | 8/2009 | Ando et al. | |
| 7,792,448 | B2 | 9/2010 | Ando et al. | |
| 8,068,778 | B2 | 11/2011 | Kaino et al. | |
| 8,331,819 | B2 | 12/2012 | Fukuzawa et al. | |
| 8,670,702 | B2 | 3/2014 | Ikegami et al. | |
| 8,712,303 | B2 | 4/2014 | Ando et al. | |
| 8,744,296 | B2 | 6/2014 | Fukuzawa et al. | |
| 8,971,744 | B2 | 3/2015 | Nihonyanagi et al. | |
| 9,002,249 | B2 | 4/2015 | Uekawa et al. | |
| 2002/0057919 | A1* | 5/2002 | Tomatsu | G03G 15/2039 399/69 |
| 2003/0196999 | A1 | 10/2003 | Kato et al. | |
| 2005/0006370 | A1 | 1/2005 | Suzumi | |
| 2006/0056891 | A1* | 3/2006 | Hashiguchi | G03G 15/2064 399/329 |
| 2009/0257794 | A1* | 10/2009 | Kaino | G03G 15/2053 399/329 |
| 2012/0155895 | A1* | 6/2012 | Shimura | G03G 15/2039 399/33 |
| 2014/0186078 | A1 | 7/2014 | Imaizumi et al. | |
| 2015/0023704 | A1 | 1/2015 | Imaizumi et al. | |

FOREIGN PATENT DOCUMENTS

| | | | |
|---|---|---|---|
| JP | 10-321352 | A | 12/1998 |
| JP | 11-84922 | A | 3/1999 |
| JP | 11-260533 | A | 9/1999 |
| JP | 2003-5572 | A | 1/2003 |
| JP | 2005-32455 | A | 2/2005 |
| JP | 2007-121955 | A | 5/2007 |
| JP | 2007-310066 | A | 11/2007 |
| JP | 2009-251435 | A | 10/2009 |
| JP | 4546233 | B2 | 9/2010 |

OTHER PUBLICATIONS

Korean Office Action dated Jun. 24, 2016, in Korean Application No. 10-2015-7015688.
Japanese Office Action dated Aug. 25, 2015 in counterpart Japanese Application No. 2013-206195.
Korean Office Action dated Jul. 11, 2017, in Korean Application No. 10-2017-7009681.
Chinese Office Action dated Jun. 27, 2017, in Chinese Application No. 201380060005.7.

* cited by examiner (a)

(b)

(c)

IMAGE HEATING APPARATUS HAVING AN ELECTRIC POWER SHUT-OFF MEMBER, THERMAL FUSE, OR THERMAL SWITCH OPERABLE IN RESPONSE TO AN ABNORMAL TEMPERATURE RISE

TECHNICAL FIELD

The present invention relates to an image heating apparatus, which is used as a fixing device mountable in an image forming apparatus such as an electrophotographic copying machine, an electrophotographic printer, and the like.

BACKGROUND ART

There has been known a fixing apparatus of the film heating type, which is mountable in an electrophotographic copying machine, an electrophotographic printer, and the like. A fixing apparatus of this type is made up of a heater, a fixation film, a pressure roller, etc. The heater has a ceramic substrate and a heat generating resistor formed on the substrate. The fixation film is placed in contact with the heater. The pressure roller is pressed against the heater, with the placement of the fixation film between itself and heater, forming thereby a nip. A sheet of recording medium on which an unfixed toner image is present is conveyed through the nip of the fixing apparatus while remaining sandwiched by the fixation film and pressure roller, whereby the toner image on the sheet of recording medium becomes fixed to the sheet of recording medium.

A fixing apparatus such as the above described one which employs a heater has a power supply circuit for supplying the heater of the fixing apparatus with electric power. Thus, if the power supply circuit becomes abnormal in operation, it sometimes suffers from the so-called "heater cracking attributable to runaway power supply circuit"), that is, the phenomenon that the heater substrate (which hereafter may be referred to simply as substrate) cracks due to malfunction of power supply circuit for heater). Thus, it is desired that a fixing device of the above-described type is designed so that it can prevent its heater substrate from cracking even if its power supplying circuit for the heater malfunctions. More concretely, if a triac, a relay, and/or the like, which is a part of the above-mentioned power supply circuit malfunctions, the power supply circuit sometimes fails to control its primary current, allowing thereby the primary current to be supplied to the heater. In such a case, the heater abnormally increases in temperature, subjecting thereby its substrate to thermal stress. If this thermal stress is large, the heater substrate sometimes cracks, making the heater unusable. Further, as the heater excessively increases in temperature, a heater holder which holds the heater may melt, which in turn may subject the heater to mechanical stress large enough to cause the substrate to crack. As the substrate of the heater cracks, the heater becomes useless.

One of the methods for preventing a fixing device of the above described type from suffering from the "heater cracking attributable to runaway power supply circuit", is to design a fixing device so that its thermal fuse, thermal switch, and/or the like component interrupts the primary current before the heater substrate is made to crack by the thermal and/or mechanical stress caused by the abnormal temperature increase of the heater, which is attributable to the flowing of the primary current of the power supply circuit into the heater. In the case of this method, it is required that the heater substrate can withstand the thermal and/or mechanical stress longer than the length of time it takes for a current interrupting member such as the thermal fuse, a thermal switch, and/or the like to react.

There is disclosed in Japanese Laid-open Patent Application 2007-121955 a technology which keeps the heater substrate as uniform as possible in temperature in order to extend the length of time it takes for the heater to crack after the power supply circuit goes out of control. More concretely, according to this patent application, a heat radiating member, which is proportional in thermal capacity to the amount of heat generation of the heat generating member on the "front" surface of the substrate, is attached to a specific portion of the back surface of the heater substrate, more specifically, the portion of the back surface of the heater substrate, which corresponds in position to the portion of the heater, which is higher in the amount of heat generation than the rest, in order to keep the heater substrate as uniform in temperature as possible.

However, the examination of a fixing device similar to the one disclosed in the abovementioned patent application revealed that it is likely that as its heater went out of control, cracking occurs to the portion of the substrate, which is in contact with a current interrupting member such as a fuse.

One of the causes for the above described problem is as follows: The current interrupting member is relatively large in thermal capacity. Therefore, the portion of the substrate, which is in contact with the current interrupting member, is robbed of heater by the current interrupting member, and therefore, reduces in temperature quicker than the rest of the substrate. Consequently, the substrate becomes nonuniform in temperature, which in turn is likely to subject the substrate to thermal stress. Further, because the current interrupting member is in contact with the substrate, the substrate is also subject to the mechanical stress attributable to the current interrupting member (substrate is pressed by current interrupting member), adding to the amount of the stress to which the substrate is subjected.

There are some cases in which a current interrupting member is attached to the substrate with the placement of a spacer made of resin, between the current interrupting member and substrate. In such cases, the spacer made of resin may melt, and therefore, the current interrupting member may come into contact with the substrate, which in turn may cause the substrate to crack as described above. Further, there are some cases in which a current interrupting member is improperly attached to the substrate due to the errors which might occur during the assembly of the heater. More concretely, if a current interrupting member is fixed to the heater substrate in such a manner that it is tilted relative to the substrate, it may come into contact with the substrate. That is, if a current interrupting member such as the thermal switch, and/or the like is tilted relative to the substrate, the end of the hard metallic member of the current interrupting member, may contact the substrate, causing the mechanical stress attributable to the current interrupting member to concentrate on the point of contact between the current interrupting member and substrate, subjecting therefore the substrate to a very large amount of force. Thus, it is more likely for the substrate to crack at the point of the substrate, which corresponds in position to the current interrupting member, as the power supply circuit goes out of control.

Further, in the case of some fixing apparatuses of the film heating type, their heater holder is provided with through hole(s), and the current interrupting member is placed in the through hole of the heater holder in such a manner that it is placed in contact with the heater substrate. In other words, the hole has to be made through the heater holder for the attachment of the current interrupting member to the heater substrate. Thus, the portions of the heater holder, which have the hole for the current interrupting member, is less in mechanical strength. While the heater is normal in operation, the heater holder can satisfactorily hold the current interrupting member. However, as the heater goes out of control and causes the heater holder to soften (or melt), the portion of the heater holder, which has the hole for the current interrupting member, fails to support the current interrupting member, allowing the current interrupting member to sink into the heater holder, allowing thereby the current interrupting member to directly come into contact with the heater substrate. In other words, the heater (substrate) is subjected to an additional stress, making it likely for the heater (substrate) to crack.

In recent years, it has come to be required that an electrophotographic copying machine, an electrophotographic printer, and the like are reduced in the FPOT (First Page Out Time; length of time required to output first print), and increased in PPM (Pages Per Minutes; number of prints which can be output per minute). In order to meet such a requirement, it is necessary to supply the heater of a fixing apparatus with a substantially larger amount of electric power than that by which a conventional fixing apparatus is supplied with electric power. Because of the circumstance described above, there is desired a fixing apparatus which can more effectively prevent the problem that as its power supply circuit goes out of control, its heater cracks, than a fixing apparatus in accordance with the prior art.

SUMMARY OF THE INVENTION

The object of the present invention is to provide an image heating apparatus which can prevent its heat generating member from cracking when the heat generating member excessively increases in temperature.

According to an aspect of the present invention, there is provided an image heating apparatus for heating a toner image formed on a recording material, said image heating apparatus comprising a heater including a substrate and a heat generating resistor thereon for generating heat for heating the toner image, by electric power supply; an electric power shut-off member operable in response to an abnormality temperature rise of said heater to shut off the electric power supply; and a heat conduction member having a thermal conductivity, in a direction of a thickness of said substrate, higher than that of said substrate, wherein a contact area between said heat conduction member and said substrate is larger than a contact area between said heat conduction member and said electric power shut-off member.

According to another aspect of the present invention, there is provided an image heating apparatus for heating a toner image formed on a recording material, said image heating apparatus comprising a heater including a substrate and a heat generating resistor thereon for generating heat for heating the toner image, by electric power supply; an electric power shut-off member operable in response to an abnormality temperature rise of said heater to shut off the electric power supply, said electric power shut-off member including a cylindrical portion, and a heat conduction member having a thermal conductivity, in a direction of a thickness of said substrate, higher than that of said substrate, wherein a cylindrical surface of the cylindrical portion of said electric power shut-off member contacts a flat surface portion of said heat conduction member, and said heat conduction member is in surface contact with said substrate.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 4 (*c*) is a schematic sectional view of the bottom portion of the heating unit of the fixing device in the first embodiment, and shows the positional relationship among the heater substrate, narrow portion of the heat generating resistor, heat conduction layer, and thermal fuse of the fixing device, and shows the positional relationship among the preceding components in terms of the direction parallel to the widthwise direction of the heating unit.

DESCRIPTION OF EMBODIMENTS

Hereinafter, some the preferred embodiments of the present invention are described in detail.

Embodiment 1

(1-1) General Description of Image Forming Apparatus

Figure 1:
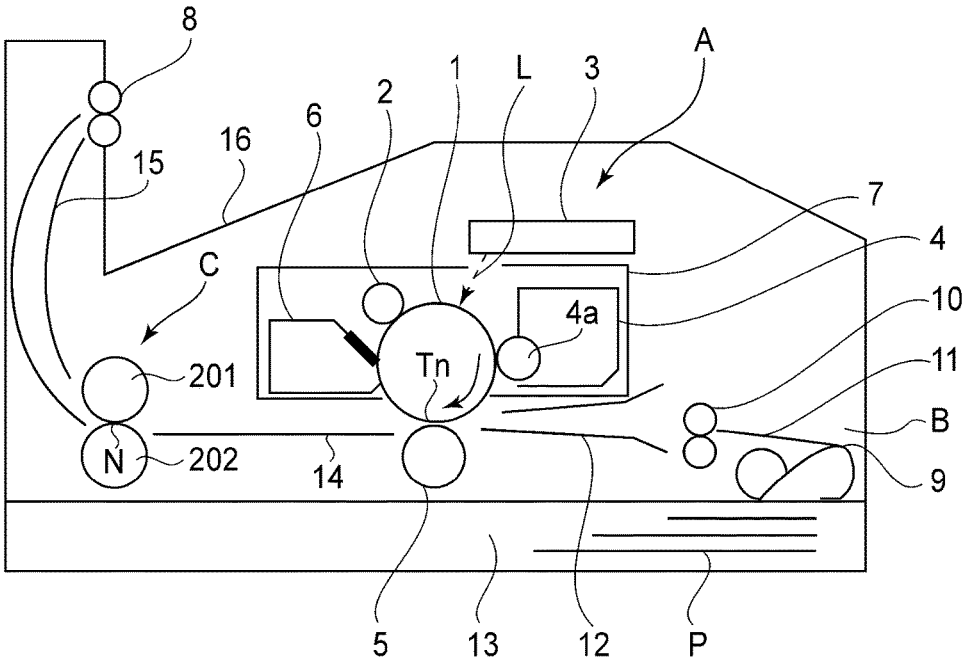
FIG. 1 is a schematic sectional view of the image forming apparatus in the first embodiment of the present invention, at a vertical plane parallel to the recording medium conveyance direction of the apparatus, and shows the general structure of the apparatus.

FIG. 1 is a schematic sectional of a typical image forming apparatus in which an image heating apparatus (device) in accordance with the present invention is mountable as the fixing device of the image forming apparatus. It shows the general structure of the image forming apparatus. This image forming apparatus is a laser beam printer, which uses an electrophotographic process. It is structured so that a sheet P of recording medium is conveyed in such a manner that in terms of the direction perpendicular to the recording medium conveyance direction of the apparatus, the center of the sheet P of recording medium coincides with the center of the recording medium conveyance passage of the apparatus.

The image forming apparatus in this embodiment has: an image forming portion A, in which an unfixed toner image is formed on a sheet P of recording medium; a fixing portion C (which hereafter may be referred to as fixing device (image heating device)) C, which fixes the unfixed toner image on the sheet P to the sheet P; etc.

In the image forming portion A, a referential code 7 stands for a process cartridge, which is made up of an electrophotographic photosensitive member (which hereafter may be referred to simply as photosensitive drum) 1, a charge roller (charging means) 2, a developing device (developing means) 4, a cleaning blade (cleaning means) 6, and a cartridge in which the preceding components are integrally disposed. The photosensitive drum 1 is an image bearing member, and is in the form of a drum. The process cartridge 7 is removably installable in the main assembly B of the image forming apparatus, that is, the image forming apparatus minus the process cartridge 7.

The image forming apparatus in this embodiment is structured so that its photosensitive drum 1 is rotated in the direction indicated by an arrow mark at a preset peripheral velocity in response to a print command issued by an external apparatus such as a host computer, a terminal device or the like on a network. As the photosensitive drum 1 is rotated, its peripheral surface is charged to preset polarity and a preset potential level by the charge roller 2. The uniformly charged portion of the peripheral surface of the photosensitive drum 1 is scanned (exposed to) a beam of laser light outputted by a laser scanner unit (exposing means) 3, while being modulated (turned on or off) according to the information of the image to be formed, which is outputted by the external apparatus. Consequently, an electrostatic latent image, which reflects the information of the image to be formed, is formed on the peripheral surface of the photosensitive drum 1.

This electrostatic image is developed into a visible image, that is, an image formed of toner (toner image) by the development roller 4*a* of the developing device 4 which uses toner. There are various developing methods, for example, jumping developing method, two-component developing method, FEED developing method, etc., which can be used by the developing device 4. These methods are likely to be used in a combination of image exposure and reversal development.

While the toner image is formed, multiple sheets P of recording medium stored in layers in a sheet feeder cassette 13 are fed one by one into the main assembly B of the image forming apparatus, by the rotation of the sheet feeder roller 9, and then, are sent to a pair of registration rollers 10 through the first sheet passage 11. Then, each sheet P of recording medium is conveyed, with a preset sheet conveyance timing, by the pair of registration rollers 10 through the second sheet passage 12, to the transfer nip Tn, which is the area of contact between the peripheral surface of the photosensitive drum 1 and the peripheral surface of the transfer roller 5.

Then, the sheet P of recording medium is conveyed through the transfer nip Tn while remaining pinched by the peripheral surface of the photosensitive drum 1 and the peripheral surface of the transfer roller 5. During the conveyance of the sheet P through the transfer nip Tn, a transfer bias which is opposite in polarity to the toner, is applied to the transfer roller 5. Thus, the toner image on the peripheral surface of the photosensitive drum 1 is electrostatically transferred onto the sheet P in the transfer nip Tn; the toner image is borne by the sheet P.

The sheet P of recording medium, on which the unfixed toner image is present, is discharged from the transfer nip Tn while being separated from the peripheral surface of the photosensitive drum 1. Then, the sheet P is introduced into the fixation nip N of the fixing device C, through the third sheet passage 14, and is conveyed through the third sheet passage 14. While the sheet P is conveyed through the fixation nip N, the unfixed toner image on the sheet P is fixed to the sheet P. Then, the sheet P is conveyed out of the fixing device C. Thereafter, the sheet P is conveyed to a pair of discharge rollers 8 through the fourth sheet passage 15.

Then, the pair of discharge rollers 8 convey further the sheet P onto the delivery tray 16 of the apparatus main assembly B.

After the separation of the sheet P of recording medium from the peripheral surface of the photosensitive drum 1, the toner and the like contaminants remaining on the peripheral surface of the photosensitive drum 1 are removed by the cleaning blade 6 to clean the peripheral surface of the photosensitive drum 1, so that the peripheral surface of the photosensitive drum 1 can be used for the following image formation.

(1-2) Fixing Device (Image Heating Apparatus) C

In the following description of the embodiments of the present invention, the lengthwise direction of the fixing device C and the structural components thereof means the direction which is parallel to the surface of a sheet of recording medium being conveyed through the fixing device C, and perpendicular to the recording medium conveyance direction of the fixing device C. The widthwise direction of the fixing device C and the structural components thereof means the direction which is parallel to the surface of a sheet of recording medium being conveyed through the fixing device C, and also, to the recording medium conveyance direction of the fixing device C. The lengthwise dimension of the fixing device C and the structural components thereof means their dimension in terms of the lengthwise direction. The widthwise dimension of the fixing device C and the structural components thereof means their dimension in terms of the widthwise direction.

Figure 2:
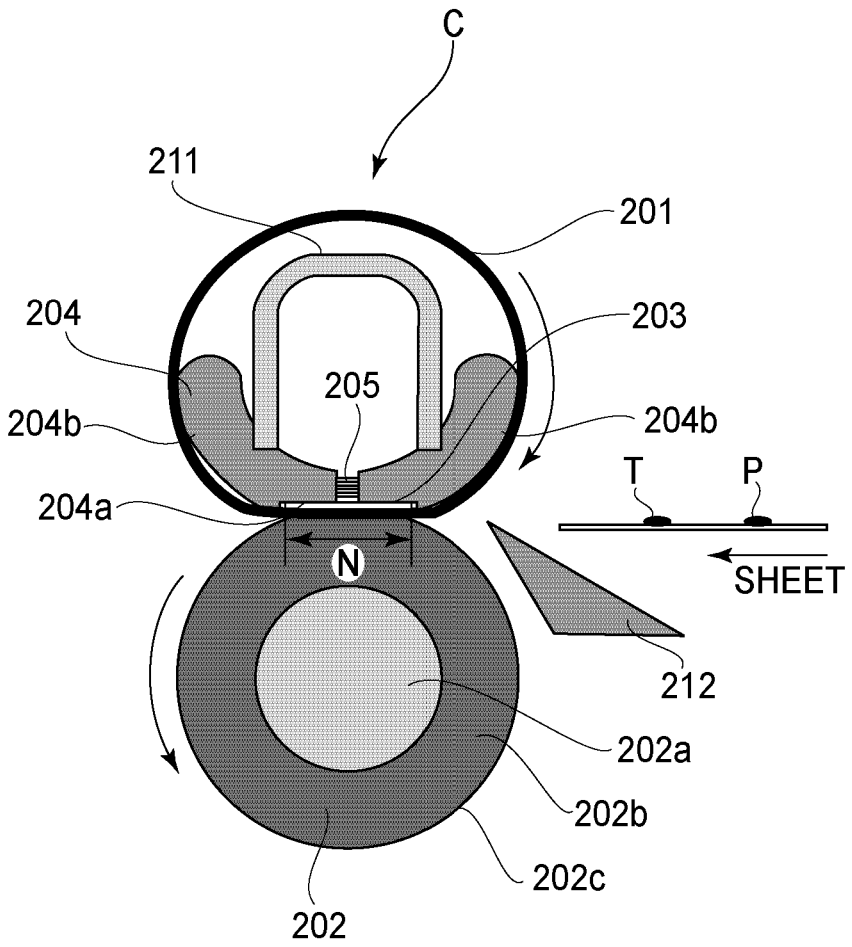
FIG. 2 is a schematic sectional view of the fixing apparatus (device) in the first embodiment, at a plane parallel to the recording medium conveyance direction of the fixing device, and shows the general structure of the fixing device.
Figure 3:
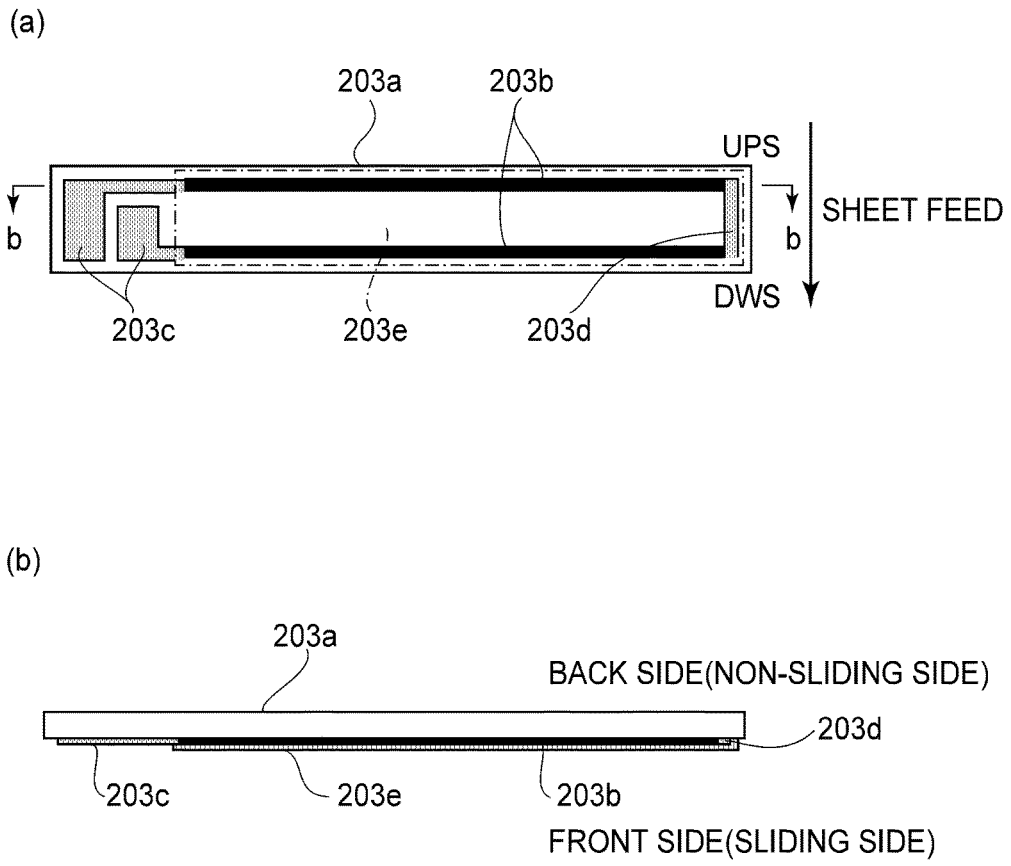
In FIGS. 3, (*a*) and 3(*b*) are schematic plan views of the heater in the first embodiment, as seen from the side where the heat generating resistor is present, and the upstream side in terms of the recording medium conveyance direction, respectively.
Figure 4:
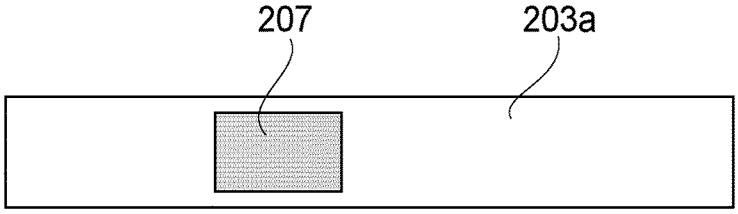
In FIG. 4, (*a*) is a plan view of the combination of the substrate of the heater of the fixing device in the first embodiment, and the heat conduction layer on the substrate, in the first embodiment; and (*b*) is a plan view of the combination of the heater, thermistor, thermal fuse, and heater holder by which the preceding components are supported, in the first embodiment, as seen from the top side of the heater holder.
Figure 4:
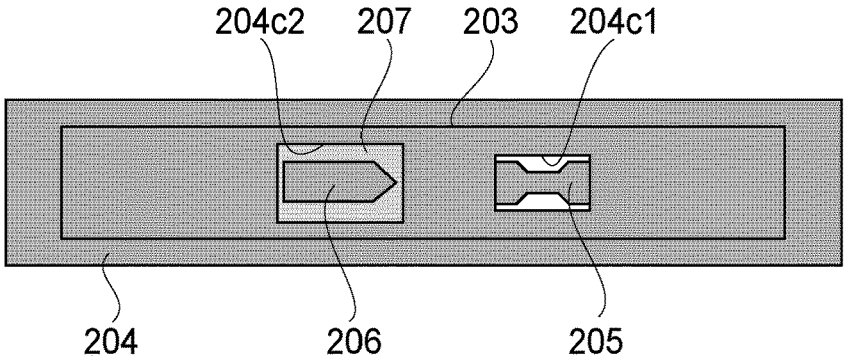
Figure 4:
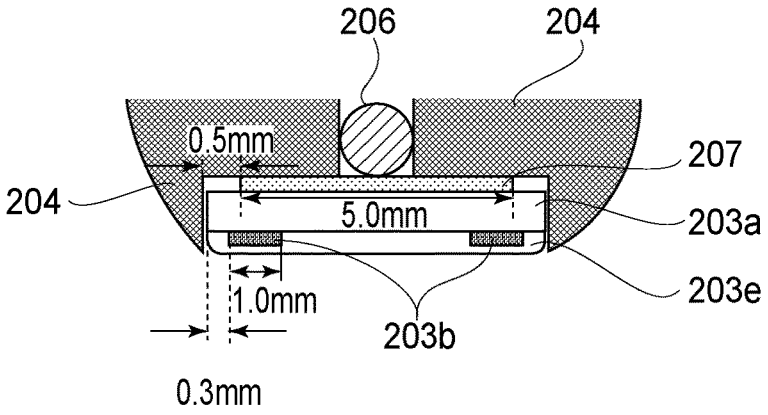

FIG. 2 is a schematic sectional view of the fixing device C in this embodiment at a vertical plane parallel to the recording medium conveyance direction of the fixing device C. It shows the general structure of the fixing device C. This fixing device C is a fixing device of the so-called film heating type. FIG. 3 is a drawing for describing the ceramic heater 203 of the fixing device C. More specifically, FIG. 3(*a*) is a schematic plan view of the ceramic heater 203 as seen from the side of the ceramic heater 203, on which the fixation film of the fixing device C slides. It shows the general structure of the heater 203. FIG. 3(*b*) is a schematic sectional view of the ceramic heater 203, at a plane (b-b) indicated by a pair of arrow marks b in FIG. 3(*a*). FIG. 4 is a diagram of the power supply circuit PS of the ceramic heater 203.

The fixing device C in this embodiment has a flexible, heat-resistant, and cylindrical fixation film (fixing member) 201, a pressure roller (pressure applying member) 202, the ceramic heater 203, a heater holder (heater supporting member) 204, a metallic stay (rigid member) 211, etc. The fixation film 201, pressure roller 202, ceramic heater 203 (which hereafter may be referred to simply as heater), heater holder 204, and metallic stay 211 are such members of the fixing device C that their lengthwise direction coincides with the lengthwise direction of the fixing device C. The heater 203 is 270 mm and 6 mm in the lengthwise and widthwise dimensions, respectively. The fixation film 201 is 230 mm in the lengthwise dimension. The lengthwise dimension of the elastic layer 202*b* (which will be described later) of the pressure roller 202 is 220 mm.

The heater holder 204 is formed of highly heat-resistant resinous substance such as PPS (polyphenylenesulfide), LCP (liquid crystal polymer), or the like. It is in the form of such a trough that is roughly semicircular in cross section. The heater holder 204 has a groove 204*a* which is in the downwardly facing surface of the heater holder 204. The groove 204*a* is centrally positioned in terms of the widthwise direction of the heater holder 204, and extends in the lengthwise direction of the heater holder 204. The heater 203 is held by the heater holder 204 by being fitted in this groove 204*a* of the heater holder 204. Further, the heater holder 204 is provided with a pair of film guiding surfaces 204*b*, which are at the widthwise ends of the heater holder 204, one for one, and by which the fixation film 202 is guided in such a manner that the fixation film 202 remains in the proper form while the fixation film 202 is circularly moved.

The metallic stay 211 is a rigid member. It is formed of a metallic substance which can provide the metallic stay 211 with a substantial amount of rigidity. It is shaped so that its cross section at a plane parallel to the widthwise direction is roughly in the form of a letter U, and also, so that its width is less than that of the heater holder 204. This metallic stay 211 is positioned above the heater holder 204 in such an attitude that its open side faces downward, and also, that its center line in terms of the widthwise direction coincides with the centerline of the heater holder 204.

The fixation film 201 is loosely fitted around the heater holder 204, to which the metallic stay 211 is attached. The fixation film 201 in this embodiment is made up of a cylindrical substrative layer (unshown) and a surface layer (parting layer) formed on the outward surface of the cylindrical substrative layer. The material for the substrative layer is a resinous substance such as thin polyimide, PEEK, or the like, or metallic substance such as SUS, nickel, or the like. The material for the surface layer is a fluorinated resin or the like which is excellent in parting properties.

The thermal capacity of the fixation film 201 is extremely small compared to that of a fixation roller employed by a conventional fixing device of the so-called heat roller type. Therefore, as electric power is supplied to the heater 203, the fixation nip N (which will be described later) of the fixing device C in this embodiment increases in temperature substantially quicker than that of a fixing device which employs a fixation roller. That is, the fixing device C in this embodiment can start up virtually instantly, that is, with virtually no waiting time; it becomes ready for image fixation very quickly.

Referring to FIGS. 3(*a*) and 3(*b*), the heater 203 has a long and narrow ceramic substrate 203*a* formed of alumina, aluminum nitride, or the like. The substrate 203*a* in this embodiment is 6.0 mm in width. Further, the heater 203 has two narrow strips 203*b* of heat generating resistor, which are formed by screen-printing or the like method, of silver-palladium alloy, or the like, on the surface of the substrate 203*a*, which opposes the inward surface of the fixation film 201, in such a manner that they extend in the lengthwise direction of the substrate 203*a*. The width of each strip 203*b* of heat generating resistor is 1.0 mm. In terms of the widthwise direction of the substrate 203*a*, the two strips 203*b* of heat generating resistor are positioned 0.3 mm inward of the edges of the substrate 203*a*, respectively. Hereafter, the surface of the substrate 203*a*, which faces the inward surface of the fixation film 201, will be referred to simply as the "surface" of the substrate 203*a*, whereas the opposite surface of the substrate 203*a* from the "surface" of the substrate 203*a* will be referred to as the "back surface" of the substrate 203*a*.

The substrate 203*a* in this embodiment is a piece of 1 mm thick aluminum plate (20 W/mK in thermal conductivity). The aforementioned two strips 203*b* of heat generating resistor are formed on the surface of the substrate 203*a*, by applying Ag/Pd (silver-palladium) paste in two strips in the lengthwise direction of the substrate 203*a*.

Further, the heater 203 is provided with a pair of power supply electrodes 203*c*, which are located at the lengthwise ends of the surface of the substrate 203*a*, being placed in contact with the two strips 203*b* of heat generating resistors, one for one. The power supply electrodes 203*c* are formed by screen-printing or the like method. The heater 203 is also provided with an electrically conductive portion 203*d*, which is at one of the lengthwise ends of the substrate 203*a*, being in contact with the two strips 203*b* of heat generating resistor. The electrically conductive portion 203*d* is formed of silver or the like substance, by screen-printing or the like method.

Regarding the method for forming the two power supply electrodes 203*c* and the electrically conductive portion 203*d*, the Ag paste was coated on one of the lengthwise ends of the surface of the substrate 203*a*, and fired, to form the two power supply electrodes 203*c*, whereas the Ag paste was coated on the other lengthwise end of the surface of the substrate 203*a*, and fired to form the electrically conductive portion 203*d*. The above described two strips 203*b* of heat generating resistor are in serial connection to the electrically conductive portion 203*d*. The measured overall electrical resistance of the combination of the serially connected two strips 203*b* of heat generating resistor was 18Ω.

Further, the heater 203 is provided with a glass coat (protective layer) 203*e* formed on the surface of the substrate 203*a* in such a manner that the glass coat 203*e* covers the two strips of heat generating resistor 203*b*, a part of the two power supply electrodes 203*c*, and electrically conductive portion 203*d*. Not only does this glass coat 203*e* protect the electrically conductive portion 203*d* from being damaged by the friction between the electrically conductive layer 203*d* and the inward surface of the fixation film 201, but also, minimize the friction between the surface of the substrate 203*a* and the inward surface of the fixation film 201 to ensure that the fixation film 201 is enabled to smoothly slide on the substrate 203*a*.

The pressure roller 202 has a metallic core 202*a* formed of iron, aluminum, or the like metallic substance. It has also an elastic layer 202*b* formed of silicone rubber, silicone sponge, or the like, on the peripheral surface of the metallic core 202*a* in a manner to cover the entirety of the peripheral surface of the metallic core 202*a*, except for the lengthwise end portions of the metallic core 202*a*, which function as the axle portion (unshown) of the pressure roller 202. The pressure roller 202 has also a parting layer 202*c* which is formed of fluorinated resin or the like, and covers the entirety of the outward surface of the elastic layer 202*b*.

The pressure roller 202 is rotatably supported by the frame (unshown) of the fixing device C. More specifically, the lengthwise end portions of the metallic core 202*a* of the pressure roller 202 are rotatably supported by a pair of bearings, with which the lateral plates of the frame of the fixing device C are provided one for one. The aforementioned heater holder 204 is above the pressure roller 202, and is positioned so that the peripheral surface of the pressure roller 202 opposes the outward surface of the fixation film 201. Further, the heater holder 204 is supported by its lengthwise end portions, by the abovementioned lateral plates (end plates in terms of lengthwise direction) of the frame of the fixing device C, in such a manner that the heater holder 204 is movable in the radius direction of the pressure roller 202.

The metallic stay 211 is placed on the upwardly facing portion of the top surface of the heater holder 204, and is kept under the preset amount of pressure generated in the vertical direction, that is, the direction perpendicular to the generatric of the fixation film 201, by a pair of pressure applying members (unshown) such as compression springs. This metallic stay 211 keeps the outward surface of the fixation film 201 pressed upon the peripheral surface of the pressure roller 202 through the heater holder 204. Therefore, the elastic layer 202*b* of the pressure roller 202 remains compressed, providing thereby the fixing device C with the fixation nip N, which is necessary for the fixation of an unfixed toner image, and has a preset width in terms of the widthwise direction, between the peripheral surface of the pressure roller 202 and the outward surface of the fixation film 201.

Next, referring to FIG. 4, the thermal fuse 206 (electric current interrupting member) and thermistor 205 (temperature detecting member) which are held by the heater holder 204 are described. FIG. 4(*a*) is a drawing of the heat conduction layer 207 on the back surface of the substrate 203*a* of the heater 203. FIG. 4(*b*) is a schematic plan view of the combination of the heater 204, thermistor 205, thermal fuse 206, and heater holder by which the preceding components are held, as seen from the top surface side of the heater holder 204. FIG. 4(*c*) is a schematic sectional view of the combination of the substrate 203*a*, pair of strips 203*b* of heat generating resistor, heat conduction layer 207, and thermal fuse 206, at a vertical plane perpendicular to the heater 203. It shows the positional relationship among these components in terms of the widthwise direction of the thermal fuse 206.

Referring to FIG. 4(*a*), the heat conduction layer 207 (heat conducting member) is on the back surface of the substrate 203*a*. It is roughly 10 μm in thickness. It is formed by coating a preset area of the back surface of the substrate 203*a*, which corresponds in position to the thermal fuse 206, with Ag paste, and firing the combination. This heat conduction layer 207 is between the thermal fuse 206 and substrate 203*a*. Its material also is Ag paste, which is the same as the material for the power supply electrode 203*c* and electrically conductive portion 203*d*. Therefore, the heat conduction layer 207 is electrically conductive.

The heat conduction layer 207 is 15 mm in length and 5 mm in width. Referring to FIG. 4(*c*), the heat conduction layer 207 is given such a shape and size that it cover the area of the substrate 203*a*, which corresponds in position to the area of the substrate 203*a*, on which the thermal fuse 206 is present, in terms of the widthwise direction of the substrate 203*a*. The area of contact between the heat conduction layer 207 and substrate 203*a* is greater in size than the area of contact between the thermal fuse 206 and heat conduction layer 207. Ag is 429 W/mK in thermal conductivity, 10.5 g/cm$^3$ in density, and 0.235 J/gK in specific heat. Thus, the thermal conductivity of the heat conduction layer 207 is greater than that of the substrate 203*a* (formed of alumina) (429 W/mK<20 W/mK).

Next, referring to FIG. 4(*b*), the heater holder 204 is provided with two through holes 204*c*1 and 204*c*2, which are perpendicular to the thickness direction of the substrate 203*a*. It is in the hole 204*c*1 that the thermistor (temperature detecting member) 205 is placed, being supported by the thermistor holding portion (unshown) located in the hole 204*c*1, in such a manner that the thermistor 205 remains in contact with the back surface of the substrate 203*a*. It is in the hole 204*c* that the thermal fuse 206 is placed, being supported by the thermal fuse holding portion provided in the hole 204*c*, in such a manner that the thermal fuse 206 remains in contact with the heat conduction layer 207 on the back surface of the substrate 203*a*.

Figure 5:
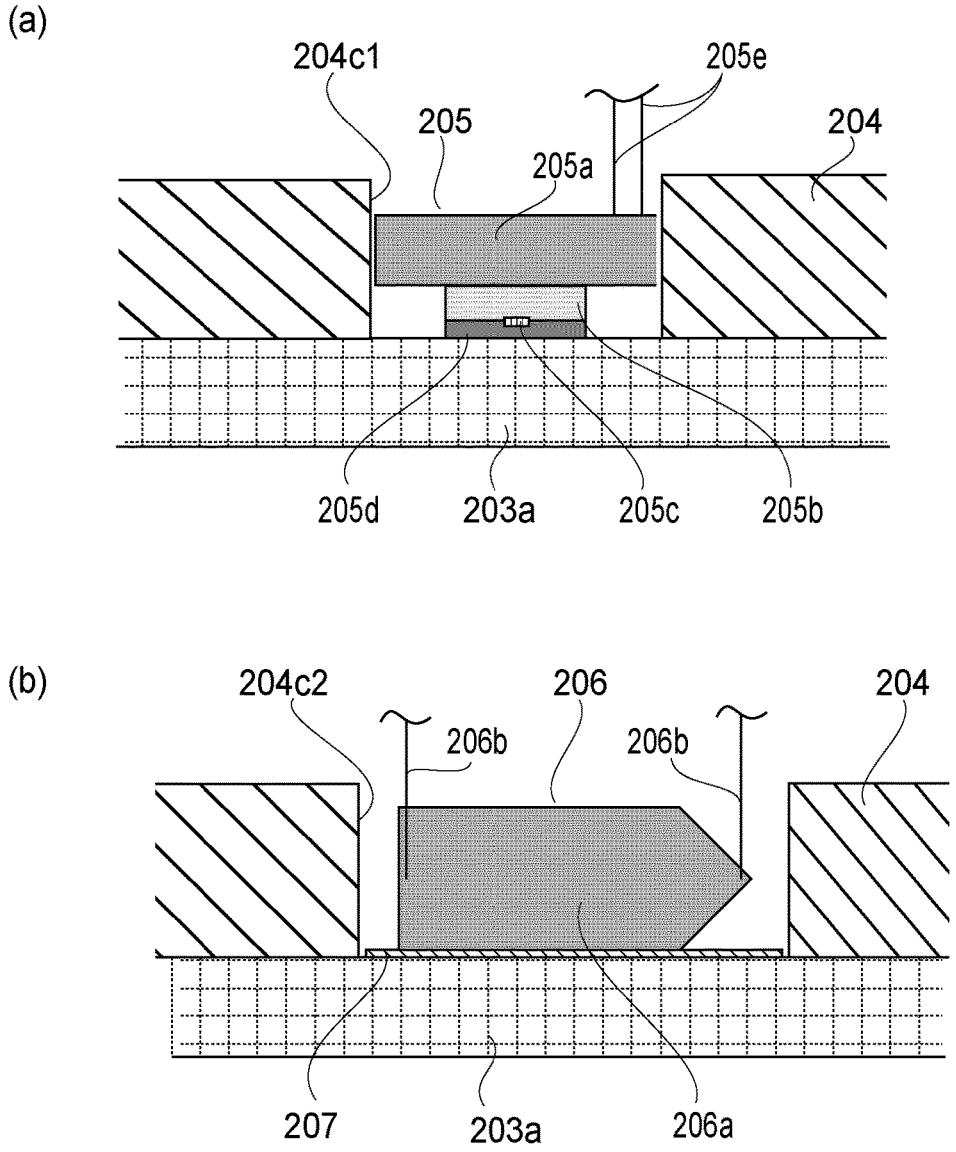
In FIG. 5, (*a*) is a schematic sectional view of the combination of the heater, heater holder, and thermistor of the fixing device in the first embodiment, at a vertical plane parallel the lengthwise direction of the heater, and shows the state of contact between the thermistor and heat conduction layer, and (*b*) is a schematic sectional view of the combination of the heater, heater holder, and thermistor of the fixing device in the first embodiment, at a vertical plane parallel the lengthwise direction of the heater, and shows the state of contact between the thermal fuse and heat conduction layer.

Next, referring to FIG. 5, the thermistor 205 which is in contact with the back surface of the substrate 203*a*, and the thermal fuse 206 which is in contact with the heat conduction layer 207 on the back surface of the substrate 203*a*, are described. FIG. 5(*a*) is a schematic sectional view of the combination of the heater 203 and heater holder 204, at a vertical plane which is parallel to the lengthwise direction and coincides in position to the thermistor 205. It shows the state of contact between the thermistor 205 and the back surface of the substrate 203*a*. FIG. 5(*b*) is a schematic sectional view of the combination of the heater 203 and heater holder 204, at a vertical plane which is parallel to the lengthwise direction and coincides in position to the heat conduction layer 207. It shows the state of contact between the thermal fuse 206 and heat conduction layer 207.

Referring to FIG. 5(*a*), the thermistor 205 is made up of a temperature sensing element 205*c*, a shell 205*a* (cover), and a sheet 205*b* of ceramic paper, or the like, for keeping stable the state of contact between the thermistor 205 and heater 203. It is structured so that the sheet 205*b* of ceramic paper or the like is positioned between the temperature sensing element 205*c* and shell 205*a* (cover). The temperature sensing element 205*c* is in connection to the primary circuit of the power supply circuit PS (which will be described later) through two pieces of Dumet wire 205*e*, or the like. Further, the thermistor 205 is provided with a layer 205*d* of electrically insulating substance, such as a piece of polyimide tape, which covers the temperature sensing element 205*c*. That is, this layer 205*d* of electrically insulating substance is placed in contact with the back surface of the substrate 203*a*. In terms of the lengthwise direction of the heater 203, the thermistor 205 is positioned at the center of the heater 203, which is always in the path of the sheet of recording medium, regardless of sheet size.

The thermal fuse 206 is such a component that senses the abnormality (excessiveness) of the heat generation of the heater 203, and breaks the primary circuit of the power supply circuit PS (which will be described later) as the heater 203 excessively increases in temperature, that is, as the heater 203 generates an excessive amount of heat. Referring to FIG. 5(*b*), the thermal fuse 206 is made up of a fuse element (unshown) which melts as its temperature exceeds a preset level, and a cylindrical metallic shell 206*a*, as an external cover for the fuse element, in which the fuse element is disposed. The fuse element is in connection to the primary circuit through a lead wire 206*b*. The heater 203 is structured so that as the temperature of the thermal fuse 206 exceeds a preset level, it interrupts the primary circuit by melting.

The metallic shell 206*a* of the thermal fuse 206 in this embodiment has a cylindrical portion. In terms of the lengthwise direction, the area of contact between the cylindrical portion of the thermal fuse 206 and the heat conduction layer 207 is roughly 10 mm. The width (diameter) of the cylindrical portion is roughly 4 mm.

The thermal fuse 206 may be attached to the heat conduction layer 207, with the placement of a layer of heat conducting grease (SC-102: product of Toray-Dow-Corning Co., Ltd., which is 2.4 t W/mK) in thermal conductivity) between itself and the heat conduction layer in order to prevent the problem that the thermal fuse 206 malfunctions due to its separation from the heat conduction layer 207.

Figure 6:
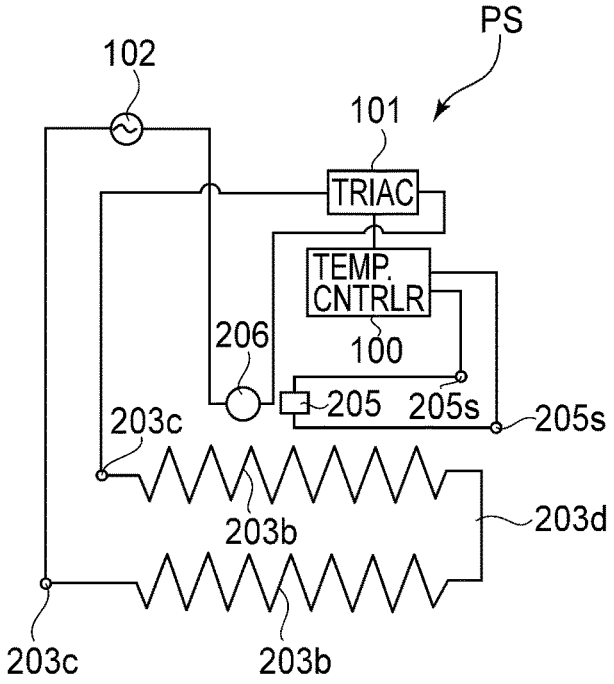
FIG. 6 is a diagram of the power supply circuit which supplies the heater with electric power.

FIG. 6 is a diagram of the power supply circuit PS for supplying the heater 203 with electrical power. In FIG. 6, a referential code 100 stands for a temperature controlling section made up of a CPU, a ROM, a RAM, etc. A referential code 101 stands for a triac (power supply control circuit). The power supply circuit PS has the primary circuit made up of an AC power source 102, thermal fuse 206, triac 101, one of the power supply electrode 203*c*, one of the two strips 203*b* of heat generating resistor, electrically conductive portion 203*d*, other strip 203*b* of heat generating resistor, other power supply electrode 203*c*, etc., which are serially connected. This primary circuit is in connection to a relay for turning on or off the triac 101, which is not shown in FIG. 6.

The power supply circuit PS has the secondary circuit made up of the temperature controlling section 100, one of the thermistor contacts 205*s*, thermistor 205, other thermistor contact 205*s*, etc., which are serially connected.

The temperature control section 100 drives the triac 101 according to the information regarding the temperature detected by the thermistor 205 attached to the center of the substrate 203*a* in terms of the lengthwise direction, controlling thereby the amount of electric power to be supplied to the strips 203*b* of heat generating resistor of the heater 203 so that the temperature of the heater 203 is kept at a preset fixation level (target level).

The methods usable by the above described control section 100 to control the electric power supply to the strips 203*b* of heat generating resistor is a multistage power control, for example, the zero-crossing wave number control which turns on or off the triac 101 for every half of the power source wave pattern, phase control which controls the power supply in phase angle for every half of the waveform of the current supplied by the power supply circuit PS, and the like method.

(1-3) Operation of Fixing Device C

The driving control section (unshown) begins to rotationally drive the motor (unshown) in response to a print start command. The rotation of the output shaft of this motor is transmitted to the gear (unshown) attached to one of the lengthwise ends of the shaft 202*a* of the pressure roller 202, whereby the pressure roller 202 is rotated in the direction indicated by an arrow mark at a preset peripheral velocity (process speed).

The rotation of the pressure roller 202 is transmitted to the surface of the fixation film 201 by the friction which occurs between the peripheral surface of the pressure roller 202 and the outward surface of the fixation film 201 in the fixation nip N. Thus, the fixation film 201 rotates (circularly moves) in the direction indicated by an arrow mark by the rotation of the pressure roller 202, with the inward surface of the fixation film 201 remaining in contact with the glass coat 203*e* of the ceramic heater 203 and the edge portions of the heater holder 204 in terms of the widthwise direction.

The temperature control section 100 turns on the triac 101 in response to the print start signal. Thus, electric current begins to flow to the strips 203*b* of heat generating resistor of the heater 203 from the AC power source 102 through the power supply terminal 203*c*. Thus, the strips 203*b* of heat generating resistor quickly increases in temperature, causing the heater 203 to heat the fixation film 201 from the inward side of the fixation film 201.

The temperature of the heater 203 (center portion) is detected by the thermistor 205. The temperature control section 100 receives the information about the temperature of the heater 203 from the thermistor 205, and controls the triac 101 based on the information about the temperature of the heater 203, so that the temperature of the heater 203 remains at the preset fixation level (target level).

While the pressure roller 202 is rotating and the temperature of the heater 203 is remaining at the preset fixation level, a sheet P of recording medium, on which a toner image T (unfixed image) is present, is introduced into, and conveyed through, the fixation nip N while being guided by the entrance guide 212, with the toner bearing surface of the sheet P facing upward. While the sheet P is conveyed through the fixation nip N, it remains sandwiched by the outward surface of the fixation film 201 and the peripheral surface of the pressure roller 202, receiving thereby heat from the fixation film 201. Further, while the sheet P is conveyed through the fixation nip N, it is subjected to the internal pressure of the fixation nip N while receiving the heat from the fixation film 201. That is, the toner image T on the sheet P is pressed by the pressure roller 202 while being melted by the heat from the fixation film 201. Consequently, the toner image T becomes fixed to the sheet P. After the fixation of the toner image T to the sheet P, the sheet P is conveyed out of the fixation nip N while being separated from the outward surface of the fixation film 201.

(1-4) Runaway Test of Fixing Device C

The fixing device C in this embodiment was subjected to a runaway test, that is, a test for finding out how the fixing device C behave as the heater 203 goes out of control.

It is when the fixing device C is continuously supplied with the largest amount of electric power which can be supplied by the image forming apparatus that the heater 203 is subjected to the largest amount of thermal stress.

Thus, it is assumed that not only the triac 101 of the primary circuit of the power supply circuit PS shorted, but also, the relay shorted at the same time. That is, a power supply circuit (PS) having a shorted triac and a shorted relay was constructed, and is connected to an unshown outlet. Since the resistance value of the strips 203*b* of heat generating resistor is 18Ω, the heater 203 will end up receiving 800 W of electric power.

This primary circuit was directly connected to the heater 203 of the fixing device C of the image forming apparatus. The length of time it took for the heater 203 (substrate 203*a*) to crack after the connection of the heater 203 to the power supply circuit PS was measured.

The thermal fuse 206 was kept disconnected from the primary circuit. Further, a low voltage power source is prepared to apply a small amount (several voltages) of voltage to the thermal fuse 206 to monitor the amount of the current which flows through the thermal fuse 206. As the thermal fuse 206 opens, the current from the low voltage power source is interrupted. Thus, by measuring the length of time it takes for the current flowing through the thermal fuse 206 to be interrupted while supplying the primary circuit with the electric power from the commercial power source, and the thermal fuse 206 with the electric power from the low voltage power source, it is possible to measure the length of time it takes for the thermal fuse 206 to open, as well.

Thus, it is possible to find out whether or not the thermal fuse 206 opens before the substrate 203*a* cracks as the heater 203 goes out of control due to the malfunctioning of the primary circuit while the fixing device C is in operation.

In the runway test for testing how the heater 203 is controlled as the power supply circuit PS goes out of control, the fixing device C in this embodiment, and a comparative fixing device, were actually tested. The comparative fixing device was not provided with the heat conduction layer 207 which is to be formed on the back surface of the substrate 203*a* by the coating the back surface with Ag paste and firing the Ag paste. In other words, the comparative fixing device was structured so that the thermal fuse 206 was attached to the back surface of the substrate 203*a*, with the presence of only the thermally conductive grease (without heat conduction layer 207). Otherwise, the comparative fixing device was the same in structure as the fixing device C in this embodiment.

When the fixing device C in this embodiment was subjected to the above-described runaway test (heater control) using the above described method, the thermal fuse 206 melted in 6.3 seconds, and it took 10.3 second for the heater 203 to crack. Thus, it is evident that there was a margin of 4 seconds between the opening of the thermal fuse 206 and the cracking of the heater 203.

The point of the substrate 203*a*, at which the substrate 203*a* cracked, corresponded in position to the thermistor 205 (point of contact between substrate 203*a* and thermistor 205). The reason for this correspondence seems to be as follows. That is, the portion of the substrate 203*a*, which is most likely to crack, that is, the portion of the substrate 203*a*, to which the thermal fuse 206 is attached, became less likely to crack. Consequently, the point of contact between the thermistor 205 and substrate 203*a*, that is, the portion of the substrate 203*a*, which is most likely to crack after the portion of the substrate 203*a* to which the thermal fuse 206 is attached, became most likely to crack.

The comparative fixing device was subjected to the same runaway test as the one to which the fixing device C in this embodiment was subjected. The length of time it took for the thermal fuse 206 to open was 6.3 seconds, which is the same as the fixing device C in this embodiment. However, the length of time it took for the substrate 203*a* of the heater 203 to crack was 6.0 seconds. That is, the aforementioned margin was smaller. In addition, the point of the substrate 203*a*, at which the substrate 203*a* cracked, was the point of contact between the thermal fuse 206 and substrate 203*a*. This seems to have occurred for the following reason. That is, the point of the substrate 203*a*, with which the thermal fuse 206, is in contact, reduced in temperature more than the other portion of the substrate 203*a*. This difference in temperature between the point of the substrate 203*a*, which is in contact with the thermal fuse 206, and the rest of the substrate 203*a*, generated thermal stress in the substrate 203*a*, which made the substrate 203*a* more likely to crack at the point of contact between the substrate 203*a* and thermal fuse 206.

In particular, the thermal fuse 206 in this embodiment has the cylindrical portion, which is in contact with the flat portion of the substrate 203*a*, by its peripheral surface, as described above. That is, the area of contact between the thermal fuse 206 and substrate 203*a* is linear or a point (thermal fuse 206 is tilted relative to substrate 203*a*). In other words, the heat of the substrate 203*a* is robbed by the thermal fuse 206 through the very small area of the substrate 203*a*, that is, the area (point) of contact between the thermal fuse 206 and substrate 203*a*. Therefore, the area of the substrate 203*a*, which is in contact with the thermal fuse 206, is likely to reduce in temperature more than the rest of the substrate 203*a*.

During the runaway test, the difference in temperature between the portion (point) of the substrate 203*a*, which corresponds in position to the thermal fuse 206, and the portion (point) of the substrate 203*a*, which corresponds in position to the strips 203*b* of heat generating resistor, was measured. More concretely, a pair of thermocouples were pasted to the portions of the surface of the substrate 203*a* of the heater 203, which is in the recording medium conveyance passage and correspond in position to the thermal fuse 206 and strips 203*b* of heat generating resistor. Then, the difference in temperature between the portion of the substrate 203*a*, which corresponds in position to the thermal fuse 206, and the portion of the substrate 203*a*, which corresponds in position to the strips 203*b* of heat generating resistor, was measured. In the case of the fixing device C in this embodiment, the difference was 27° C. even 10 seconds after the starting of the runaway test. In comparison, in the case of the comparative fixing device, it became 66° C. six seconds after the starting of the runaway test.

To roughly calculate the amount of the thermal stress to which the substrate 203*a* is subjected, $\sigma=E\alpha\Delta T$ ($\sigma$: thermal stress, E: Young's modulus, $\alpha$: coefficient of linear expansion, $\Delta T$: temperature difference).

Since alumina is $3.5\times10^5$ in Young's modulus and $7.8\times10^{-6}$ (/° C.) in coefficient of linear expansion, the amount of thermal stress to which the substrate 203*a* is subjected 10 seconds after the starting of the runaway test is 73.7 MPa/mm$^2$.

In comparison, the amount of thermal stress to which the substrate 203*a* of the comparative fixing device is subjected 10 seconds after the starting of the runaway test, which is obtainable with the use of the same calculating method used for the fixing device C in this embodiment, is roughly 180 MPa/mm$^2$. Even though the tensile strength of aluminum is roughly 255 MPa/mm$^2$, the substrate 203*a* is also subjected to the mechanical stress from the pressure roller 202, etc. Therefore, it has been empirically known that the substrate 203*a* of the heater 203 is likely to crack as the amount of thermal stress to which the substrate 203*a* is subjected increase to a value in a range of 150-200 MPa/mm$^2$.

In the case of the fixing device C in this embodiment, its thermal fuse 206 is attached to the heat conduction layer 207 which is on the back surface of the substrate 203*a*. Therefore, it is reasonable to think that the portion of the substrate 203*a*, which corresponds in position to the thermal fuse 206, that is, the portion of the substrate 203*a*, which is the largest in the amount of thermal stress, and also, the amount of mechanical stress, is smaller in the amount of stress than the same portions of the substrate 203*a* of the comparative fixing device. Therefore, it is also reasonable to think that the fixing device C (substrate 203*a*) in this embodiment lasts longer than the comparative fixing device. More specifically, in the case of the fixing device C in this embodiment, which is structured as described above, heat is robbed from the substrate 203*a* by the thermal fuse 206 through the heat conduction layer 207 as the heater 203 goes out of control. The area of contact between the heat conduction layer 207 and substrate 203*a* is larger than the area of contact between the thermal fuse 206 and heat conduction layer 207. Thus, the fixing device in this embodiment is greater in the area of the substrate 203*a*, through which heat is robbed from the substrate 203*a* by the thermal fuse 206, than the comparative fixing device. That is, in the case of the fixing device C in this embodiment, the area of the substrate 203*a* of the heater 203, from which heat is robbed by the thermal fuse 206, is larger (wider) than in the case of the comparative fixing device. Therefore, the substrate 203*a* in this embodiment is unlikely to locally reduce in temperature.

Also in the case of the comparative fixing device, the portion of the substrate 203*a*, which corresponds in position to the thermal fuse 206, is coated with thermally conductive grease. However, the thermal conductivity of the thermally conductive grease is lower than the alumina, which is the material for the substrate 203*a*. Therefore, the thermal conductive grease alone is insufficient to keep the substrate 203*a* virtually uniform in temperature. That is, in order to keep the substrate 203*a* virtually uniform in temperature, the thermally conductive layer 207, which is formed of a substance which is higher in thermal conductivity than the substrate 203*a*, is necessary.

As described above, in the case of the fixing device C in this embodiment, the heat conduction layer 207, which is greater in thermal conductivity is attached to the back surface of the substrate 203*a* of the heater 203, and the metallic shell 206*a* of the thermal fuse 206 is placed in contact with the heat conduction layer 207. Thus, the portion of the substrate 203*a*, which corresponds in position to the thermal fuse 206, is minimized in nonuniformity in terms of thermal stress, when the heater 203 abnormally increases in temperature. Therefore, it is longer in the length of time it takes for the substrate 203*a* to crack. That is, the thermal fuse 206 opens before the heater 203 cracks when the power supply circuit PS goes out of control. In other words, the fixing device C in this embodiment is unlikely to suffer from the problem that as the power supply circuit PS goes out of control, the heater 203 abnormally increases in temperature, and therefore, the substrate 203*a* of the heater 203 cracks.

Embodiment 2

Figure 7:
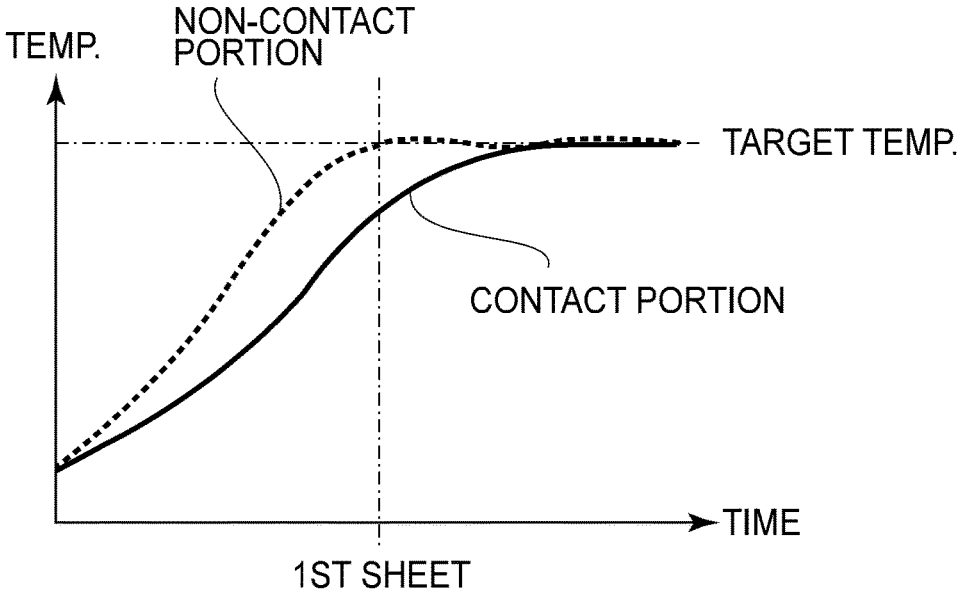
FIG. 7 is a graph which shows the speed at which the portion of the substrate of the conventional heater of a fixing device, which is in contact with the thermal fuse, increases in temperature, and the speed at which the rest of the substrate of the conventional heater of the fixing device, increases in temperature.
Figure 8:
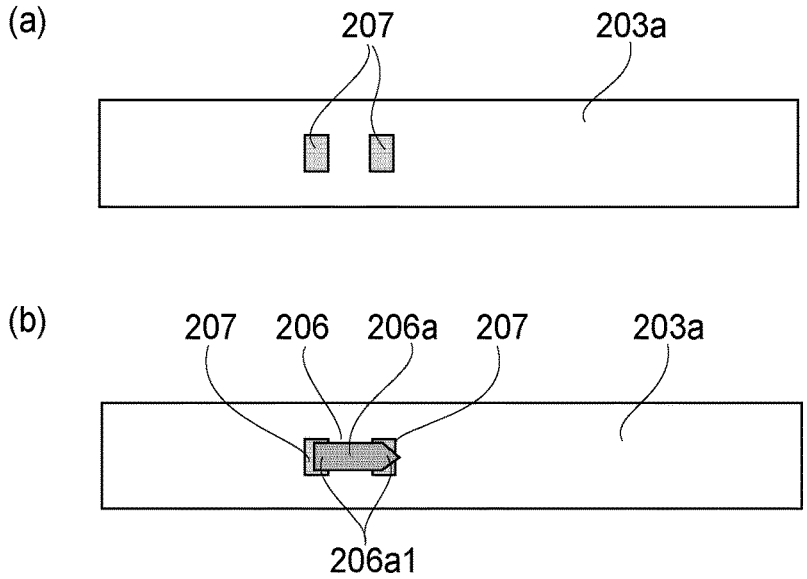
In FIG. 8, (*a*) is a schematic drawing of the heater of the fixing apparatus in the second embodiment of the present invention, which is provided with a heat conduction layer, and (*b*) is a drawing of the heater shown in (*a*) after the placement of the thermal fuse to the heat conduction layer.

Next, the fixing device C in another (second) embodiment of the present invention is described. FIG. 7 is a drawing (graph) for describing the fixing device C in this embodiment of the present invention. It shows the difference in the speed at which the portion of the substrate 203*a*, with which the thermal fuse 206 is in contact, increases in temperature, and the rest of the substrate 203*a*, as the first sheet of recording medium is introduced in to the fixation nip of a conventional fixing apparatus (device), that is, a fixing device which employs a heater having no thermally conductive layer. FIG. 8 is a drawing for describing the positional relationship among the heater 203, heat conduction layer 207, and thermal fuse 206 of the fixing device C in this embodiment. More specifically, FIG. 8(*a*) shows the substrate 203*a*, and the heat conduction layers 207 which is on the back surface of the substrate 203*a*. FIG. 8(*b*) shows the substrate 203*a*, heat conduction layer 207 (shown in FIG. 8(*a*)) on the back surface of the substrate 203*a*, and the thermal fuse 206 on the heat conduction layer 207.

The fixing device C in this embodiment is structured so that the heat conduction layer 207 to be placed on the back surface of the substrate 203*a* can be minimized in size, and also, so that the thermally conductive grease is unnecessary. This structural arrangement also can provide a fixing device C which can prevent the problem that when the heater 203 is started up, the portion (point) of the substrate 203*a*, which corresponds in position to the thermal fuse 206, is reduced in temperature by the thermal capacity of the thermal fuse 206. It is also effective to prevent the problem that as the power supply circuit PS goes out of control, the substrate 203*a* of the heater 203 cracks.

In the case where the thermal fuse 206 is placed directly in contact with the back surface of the substrate 203*a*, there occurs a difference in temperature between the portion of the substrate 203*a*, to which the thermal fuse 206 is attached, and the rest of the substrate 203*a*, because of the thermal capacity of the thermal fuse 206 itself, while the heater 203 is started up, that is, while the heater 203 is increased in temperature to the fixation level, in particular, from the room temperature.

Referring to FIG. 7, the moment the first sheet P of recording medium is introduced into the fixation nip N, there is a certain amount of difference in temperature between the portion of the substrate 203*a*, which is in contact with the thermal fuse 206, and the rest of the substrate 203*a*. That is, the portion of the substrate 203*a*, which is in contact with the thermal fuse 206 is lower in temperature than the rest of the substrate 203*a*. Therefore, it sometimes occurs such phenomena that the portion of the toner image, which corresponds in position to the area of contact between the substrate 203*a* and thermal fuse 206, is fixed with less gloss, and/or is less satisfactory in fixation.

The fixing device C in this embodiment is capable of preventing the portion of the substrate 203*a*, which is in contact with the thermal fuse 206 from becoming lower in temperature than the rest, and therefore, can prevent the problem that as the power supply circuit PS goes out of control, the substrate 203*a* of the heater 203 cracks.

Referring to FIG. 8(*a*), two portions of the back surface of the substrate 203*a*, which correspond in position to the lengthwise ends 206*a*1 of the metallic shell 206*a* of the thermal fuse 206, are provided with a pair of heat conduction layers 207, one for one, which are roughly 10 μm in thickness and were formed through a process of coating the abovementioned two portions of the back surface of the substrate 203*a* with Ag paste, and firing it. That is, the two heat conduction layers 207 correspond in position to the end portions 206*a*1 of the metallic shell 206*a* of the thermal fuse 206, one for one. Each heat conduction layer 207 is 3 mm in dimension in terms of the lengthwise direction, and 5 mm in dimension in terms of the widthwise direction. The end portions 206*a*1 of the metallic shell 206*a* of the thermal fuse 206 are directly in contact with the pair of heat conduction layers 207, that is, without the presence of the thermally conductive grease between the lengthwise end portions 206*a*1 and heat conduction layers 207.

The metallic shell 206*a* of the thermal fuse 206 is likely to be cylindrical. Thus, it sometimes occurs that the thermal fuse 206 (metallic shell 206*a*) is disposed slightly tilted, and therefore, one of the end portions 206*a*1 of the metallic shell 206*a* is placed in contact with the back surface of the substrate 203*a*. In a case where one of the end portions 206*a*1 is placed in contact with the back surface of the substrate 203*a*, the substrate 203*a* is affected in temperature distribution only at the point of contact between the back surface of the substrate 203*a* and the end portion 206*a*1 of the metallic shell 206*a*, that is, across very small area of the substrate 203*a*. Therefore, in a case where the thermal fuse 206 is attached to the substrate 203*a* so that it is angled relative to the substrate 203*a*, the substrate 203*a* is likely to crack, which has been empirically known.

As for the means for prevent the problem that if the thermal fuse 206 is attached to the substrate 203*a* so that it is angled relative to the substrate 203*a*, the substrate 203*a* of the heater 203 is likely to crack as the power supply circuit PS goes out of control, it is effective to place the heat conduction layer 207 on the back surface of the substrate 203*a* in such a manner that the heat conduction layer 207 covers the point of contact between the thermal fuse 206 and the back surface of the substrate 203*a*.

When the heater 203 of the fixing device C, in this embodiment, which is in an image forming apparatus, was started up, the portion of the back surface of the substrate 203*a*, which corresponds in position to the thermal fuse 206, and the rest, were the same in temperature change. Further, even the first print was not less in image quality, such as glossiness, than a satisfactory print.

When the fixing device C in this embodiment was subjected to the runaway test similar to the one to which the fixing device C in the first embodiment was subjected, it took 7.2 seconds for the thermal fuse 206 to open, whereas it took 9.8 seconds for the heater 203 (substrate 203*a*) to crack. It is evident from the results of this test that there was sufficient amount of time for the thermal fuse 206 to prevent the heater 203 (substrate 203*a*) from cracking, should the power supply circuit PS go out of control.

In the above-described runaway test, a pair of K thermocouples were pasted to the portions of the surface of the substrate 203*a* of the heater 203, which is in the recording medium conveyance passage and correspond in position to the thermal fuse 206 and strips 203*b* of heat generating resistor, one for one. Then, the temperature of these portions were detected. The difference in temperature between the portion of the substrate 203*a*, which corresponds in position to the strips 203*b* of heat generating resistor, and the portion of the substrate 203*a*, which corresponds in position to the thermal fuse 206, was 28° C., and the amount of thermal stress was 76.4 MPa/mm$^2$.

In the case of the comparative fixing device, the heat conduction layer 207 was not formed on the back surface of the substrate 203*a* (process of coating Ag paste on back surface of substrate 203*a* and firing it was not carried out), and the thermal fuse 206 was directly disposed on the substrate 203*a*, that is, without placing a layer of thermally conductive grease between the thermal fuse 206 and substrate 203*a*. In other words, the comparative fixing device is the same in structure as the fixing device C in this embodiment, except for the above-described difference. This comparative fixing device was subjected to the same runaway test as the one to which the fixing device C in this embodiment was subjected. It took 7.4 seconds for the thermal fuse 206 to open, where as it took 6.2 seconds for the heater 203 (substrate 203*a*) to crack. Further, the point at which the heater 203 (substrate 203*a*) cracked was the point of contact between one of the lengthwise end portion 206*a*1 of the metallic shell 206*a* of the thermal fuse 206.

6.0 seconds after starting the runaway test, the difference in temperature between the portion of the substrate 203*a*, which corresponds in position to the strips 203*c* of heat generating resistor, and the portion of the substrate 203*a*, which corresponds in position to the thermal fuse 206, was 65° C., and the amount of thermal stress was 177.4 MPa/mm$^2$.

Also in the case of the comparative fixing device in this embodiment, unless the heat conduction layer 207 is provided, the portion of the substrate 203*a*, which is in contact with one of the lengthwise ends 206*a*1 of the metallic shell 206*a* of the thermal fuse 206, is subjected to a large amount of thermal stress, and also, the aforementioned mechanical stress. This seems to be the reason why the heater 203 (substrate 203*a*) cracked.

As described above, in the case of the fixing device C in this embodiment, two thermally conductive layer layers 207 are placed on the two separate areas of the back surface of the substrate 203*a*, one for one, and the lengthwise end portions 206*a*1 of the metallic shell 206*a* of the thermal fuse 206 are placed in contact with the two thermally conductive layers 207, one for one. Thus, the presence of these thermally conductive layers 207 can minimize in severity the phenomenon that as the heater 203 abnormally increases in temperature, the portion of the substrate 203*a*, which corresponds in position to the thermal fuse 206 becomes nonuniform in thermal stress. That is, the second embodiment also can provide the effects similar to those which can be provided by the first embodiment.

Embodiment 3

Figure 9:
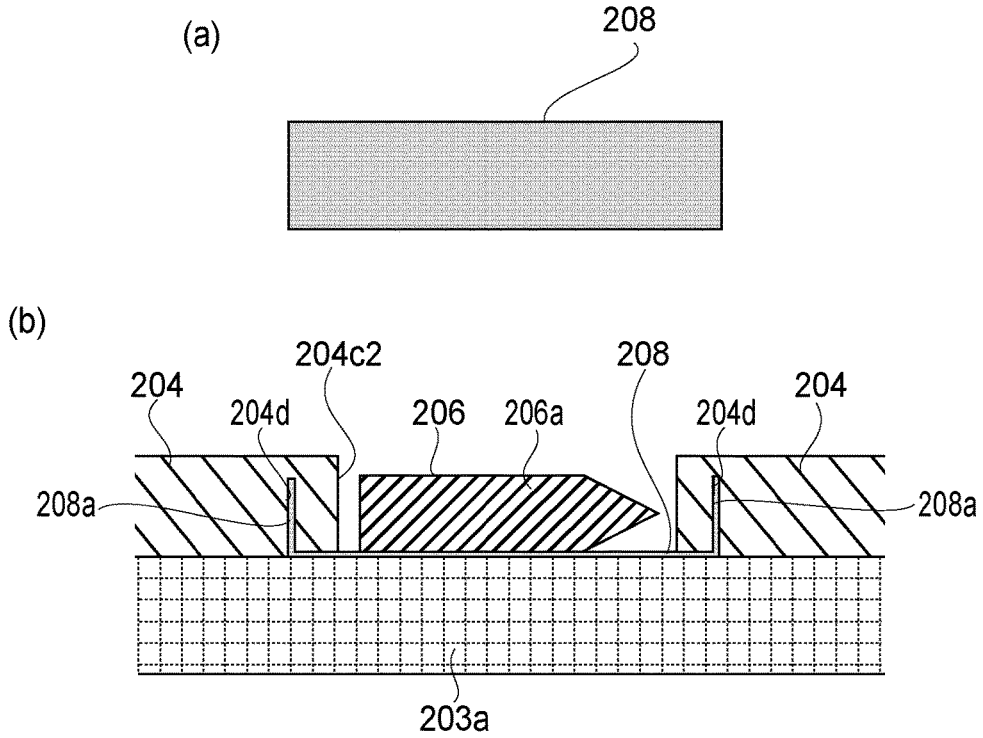
In FIG. 9, (*a*) is a plan view of the aluminum plate, with which the fixing device in the third embodiment is provided, and (*b*) is a schematic sectional view of the combination of the heater and heater holder in the third embodiment, at a plane parallel to the lengthwise direction of the heater, after the thermal fuse came in contact with the heat conduction layer.

Next, another (third) embodiment of the present invention is described. FIG. 9 is a drawing for describing the relationship among the heater 203, aluminum plate 208, and thermal fuse 206 of the fixing device C in this embodiment. More specifically, FIG. 9(*a*) is a plan view of the aluminum plate 208, and FIG. 9(*b*) is a schematic sectional view of the combination of the heater 203 and heater holder 204, at a vertical plane parallel to the lengthwise direction. It shows the state of contact between the thermal fuse 206 and aluminum plate 208.

The fixing device C in this embodiment does not have the heat conduction layer 207 on the back surface of the substrate 203*a*. Instead, the back surface of the substrate 203*a* is provided with the aluminum plate 208, which can provide the same effects as those which can be provided by the thermally conductive layer 207. Otherwise, the fixing device C in this embodiment is the same in structure as the one in the fixing device C in the first embodiment.

Referring to FIG. 9(*a*), all that is required of the aluminum plate 208 is that its size is such that the area of contact between the aluminum plate 208 and substrate 203*a* becomes greater than the area of contact between the aluminum plate 208 and thermal fuse 206. In this embodiment, the aluminum plate 208 is 20 mm in terms of the lengthwise direction, 5 mm in terms of the widthwise direction, and 0.3 mm in thickness. It is 237 W/mK in thermal conductivity. That is, it is greater in thermal conductivity than the substrate 203*a* (alumina plate) (237 W/mK>20 W/mK).

In the case of this embodiment, the thermal conductivity of the substrate 203*a* as a thermally conductive member, in terms of its thickness direction, is particularly important, because the thermal fuse 206 detects the temperature of the heater 203 through the aluminum plate 208. Thus, such a material as graphite plate that is anisotropic in thermal conductivity, that is, its thermal conductivity in its thickness direction is substantially smaller than that in its surface direction, is difficult to use as the material for the thermally conductive member in this embodiment, because the thermal conductivity of the graphite sheet in its thickness direction is smaller than the thermal conductivity of the substrate 203*a* which is formed of ceramic such as alumina.

Referring to FIG. 9(*b*), the aluminum plate 208 is bent so that its cross section at a plane parallel to the lengthwise direction appears roughly in the shape of a letter U. It is fixed to the heater holder 204, with a pair of its vertical portions 208*a* formed by bending the edge portions of the aluminum plate 208, in terms of the lengthwise direction, being inserted into a pair of slots 204*d* with which the heater holder 204 is provided. The thermal fuse 206 is placed in the hole 204*c*2 of the heater holder 204, in such a manner that its metallic shell 206*a* is placed in contact with the aluminum plate 208.

The fixing device C in this embodiment was subject to the same runaway test as the one to which the fixing device C in the first embodiment was subjected. The results of the test are as follows. The length of time it took for the thermal fuse 206 to open was 6.3 seconds, which is the same as the fixing device C in the first embodiment. However, the length of time it took for the heater 203 (substrate 203*a*) to crack was 13.2. In other words, this embodiment was more effective to prevent the heater 203 (substrate 203*a*) from cracking, that is, to extend the heater 203 in service life, than the first embodiment.

Aluminum which is the material for the aluminum plate 208, is lower in thermal conductivity than Ag which is the material for the heat conduction layer 207 in the first embodiment. However, the thickness of the aluminum plate 208 is roughly 0.3 mm, which is roughly 30 times the thickness of the Ag paste in the first embodiment, which is 10 μm. Therefore, it is greater in thermal conduction (transfer), being more effective to make the substrate 203*a* uniform in temperature, than the Ag paste. The portions of the surface of the substrate 203*a*, which are in the recording medium passage and correspond in position to the thermal fuse 206 and strips 203*b* of heat generating resistor, are measured in temperature by a couple of K thermocouples attached thereto, one for one. 13 seconds after the starting of the runaway test, the difference in temperature between the portions of the surfaces of the substrate 203*a*, which correspond in position to the strips 203*c* of heat generating resistor and thermal fuse 206, respectively, was 28° C., and the amount of thermal stress was 76.4 MPa/mm$^2$.

Further, the aluminum plate 208 is rigid by itself. Therefore, even if the heater holder 204 melts, the aluminum plate 208 can prevent a part, or parts, of the heater 203 from buckling. Therefore, it seems to reasonable to think that this embodiment can further extend the fixing device C (heater 203) in service life.

As described above, in the case of the fixing device C in this embodiment, the metallic shell 206*a* of the thermal fuse 206 is placed in contact with the aluminum plate 208 which is placed on the back surface of the substrate 203*a* of the heater 203 and is greater in thermal capacity than the substrate 203*a*. Therefore, the aluminum plate 208 can minimize the problem that as the heater 203 abnormally increases in temperature, the portion of the substrate 203*a*, which corresponds in position to the thermal fuse 206 becomes nonuniform in thermal stress. In other words, this embodiment can provide the same effects as the first embodiment.

Embodiment 4

Figure 10:
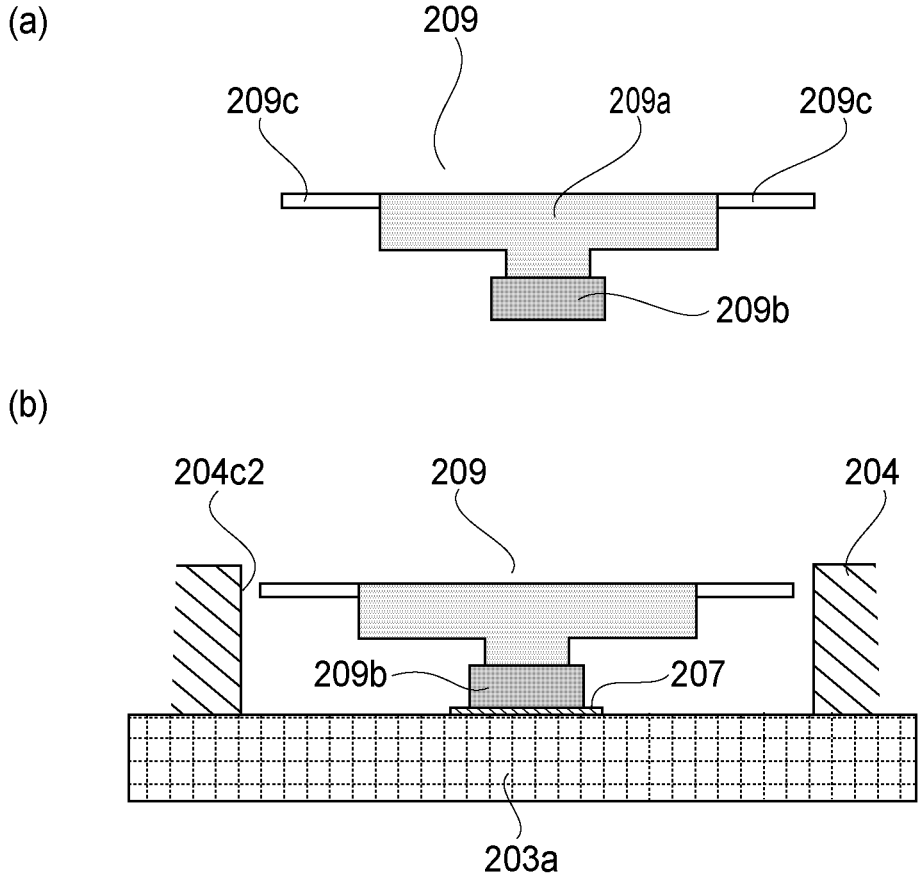
In FIG. 10, (*a*) is a schematic drawing of the thermoswitch in the fourth embodiment of the present invention, and shows the structure of the thermoswitch, and (*b*) is a schematic sectional view, at a vertical plane parallel to the lengthwise direction of the combination, of the combination of the heater and heater holder, which is structured so that the heat conduction layer of the heater is placed on the substrate of the heater, with the placement of the heat conduction layer between the thermoswitch and substrate.

Next, another (fourth) embodiment of the present invention is described. FIG. 10 is a drawing for describing the relationship among the heater 203, heat conduction layer 207, and thermoswitch 209 of the fixing device C in this embodiment. More specifically, FIG. 10(*a*) is a drawing for describing the structure of the thermoswitch 209. FIG. 10(*b*) is a schematic sectional view of the combination of the heater 203 and heater holder 204 at a vertical plane parallel to the lengthwise direction. It shows the positional relationship among the substrate 203*a*, heat conduction layer 207, and thermoswitch 209; the heat conduction layer 207 is placed between the substrate 203*a* and thermoswitch 209.

In the case of the fixing device C in this embodiment, the thermoswitch 209 was employed as a current interrupting member, in place of the thermal fuse 206. Otherwise, the fixing device C in this embodiment is the same in structure as the fixing device C in the first embodiment.

Referring to FIG. 10(*a*), the thermoswitch 209 has: a shell 209*a* which makes up the external cover of the thermoswitch 209; heat sensing portion 209*b*; a lead wire connection portion 209*c*; etc. There is disposed a bimetal (unshown) in the heat sensing portion 209*a*. As the heat sensing portion 209*b* increases in temperature higher than a preset level, the bimetal reverses in curvature, moving thereby upward a pin (unshown), which is above the bimetal. This upward movement of the pin separates a pair of contacts (unshown) in the shell 209*a* from each other. Consequently, the primary current is interrupted.

Referring to FIG. 10(*b*), the thermoswitch 209 is placed on the heat conduction layer 207, with the placement of a layer of thermally conductive grease between the thermoswitch 209 and the layer of thermally conductive grease, which functions to prevent the problem that the thermoswitch 209 separates from the heat conduction layer 207.

When the fixing device C in this embodiment was subjected to the same runaway test as the one to which the fixing device C in the first embodiment was subjected, it took 3.5 seconds for the thermoswitch 209 to turn itself off, where the length of time it took for the heater 203 (203*a*) to crack was 10.3 seconds, which was the same as the fixing device C in the first embodiment. It is evident from these results that the employment of the thermoswitch 209 can provide a substantial amount of margin in time between the point in time at which the thermoswitch 209 reacts and the point in time at which the heater 203 (substrate 203*a*) cracks.

As described above, in the case of the fixing device C in this embodiment, the heat sensing portion 209*b* of the thermoswitch 209 is placed in contact with the heat conduction layer 207 which is on the back surface of the substrate 203*a* of the heater holder 204 and is greater in thermal conductivity than the substrate 203*a*. Thus, the heat conduction layer 207 can minimize in severity the problem that as the heater 203 abnormally increases in temperature, the portion of the substrate 203*a*, which corresponds in position to the thermal fuse 206, becomes nonuniform in thermal stress. In other words, this embodiment also can provide the same effects as the first embodiment.

Embodiment 5

Figure 11:
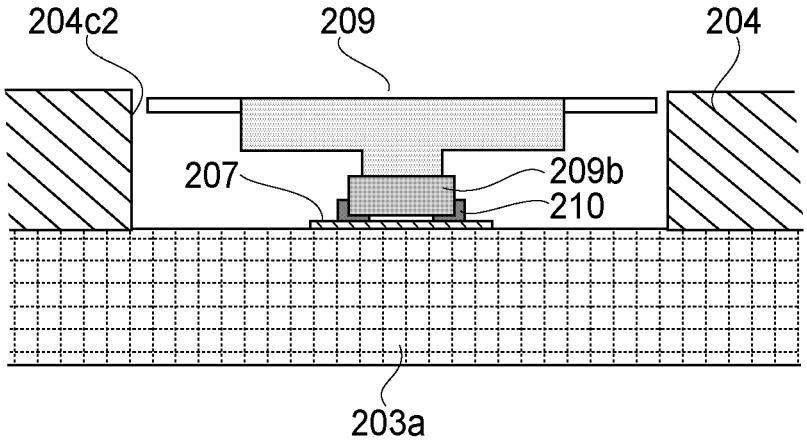
FIG. 11 is a schematic sectional view of the combination of the heater and heater holder in the fifth embodiment of the present invention, at a vertical plane parallel to the lengthwise direction of the heater (heater holder), and shows the positional relationship among the heater, thermoswitch spacer, and thermoswitch.

Next, another (fifth) embodiment of the present invention is described. FIG. 11 is a drawing for showing the relationship among the heater 203, thermoswitch spacer 210, and thermoswitch 209 of the fixing device C in this embodiment.

In the case of the fixing device C in this embodiment, the thermoswitch spacer 210 was placed between the thermoswitch 209 which is similar to the one in the fourth embodiment, and the substrate 203*a*. Otherwise, the fixing device C in this embodiment is the same in structure as the one in the first embodiment.

Referring to FIG. 11, the thermoswitch spacer 210 is shaped so that its cross section at a plane parallel to the lengthwise direction is roughly in the form of a letter L. This thermoswitch spacer 210 is placed between the thermoswitch 209 and substrate 203*a* to support the thermoswitch 209 in such a manner that 0.5 mm of space is provided between the heat sensing portion 209*b* of the thermoswitch 209 and the substrate 203*a* while the heater 203 is normal in operation (while heat 203 is being properly controlled in temperature).

It is desired that a resinous substance, the melting point of which is such that it melts only as the heater 203 abnormally increases in temperature because the power supply circuit PS is out of control, is used as the material for the thermoswitch spacer 210. That is, it is desired that a resinous substance which is thermally meltable only as the heater 203 abnormally increases in temperature because the power supply circuit PS is out of control, is used as the material for the thermoswitch spacer 210. With a resinous substance which is lower in melting point than the heater holder 204 being used as the material for the thermoswitch spacer 210, as the heater holder 204 melts, the thermoswitch 209 comes into contact with the heat conduction layer 207 on the substrate 203*a*. Consequently, the thermoswitch 209 functions. Here, the thermoswitch spacer 210 is less in thermal conductivity than the substrate 203*a*.

The operating temperature of the thermoswitch 209 is no higher than roughly 250° C. Thus, in a case where the fixation temperature needs to be higher than the operating temperature of the thermoswitch 209, the heat sensing portion 209*c* of the thermoswitch 209 is not to be in contact with the back surface of the substrate 203*a*. This is why the fixing device C in this embodiment is structured so that the thermoswitch spacer 210 made of the resinous substance, which can thermally melted as described above, is placed between the thermoswitch 209 and heat conduction layer 207.

In the case of the fixing device C in this embodiment, when the heater 203 is normal in operation, a preset amount of gap remains between the heat sensing portion 209*b* of the thermoswitch 209 and the back surface of the substrate 203*a*. However, as the power supply circuit PS goes out of control, the thermoswitch spacer 210 melts, and therefore, the heat sensing portion 209*b* of the thermoswitch 209 comes into contact with the heat conduction layer 207 on the back surface of the substrate 203*a*. Thus, the heater 203 can be used at a temperature level which is higher than the operating temperature of the thermoswitch 209, and yet, can be prevented from operating as the peripheral surface PS goes out of control. Further, the heat conduction layer 207 is present on the substrate 203*a*. Therefore, the fixing device C in this embodiment is as small as the fixing device C in the first embodiment, in the amount of thermal stress to which the portion of the substrate 203*a*, which corresponds in position to the thermoswitch 209, is subjected as the thermoswitch 209 comes into contact with the substrate 203*a*. In other words, this embodiment is just as effective as the first embodiment to prevent the substrate 203*a* from cracking.

When the fixing device C in this embodiment was subjected to the same runaway test as the one to which the fixing device C in the first embodiment was subjected, the length of time it took for the thermoswitch 209 to react was 5.6 seconds, whereas the length of time it took for the heater 203 (substrate 203*a*) to crack was 11.0 seconds. Thus, it is evident that this embodiment provide a satisfactory amount of margin in time between the point in time at which the thermoswitch 209 reacts and the point in time at which the heater 203 (substrate 203*a*) cracks.

Embodiment 6

Figure 12:
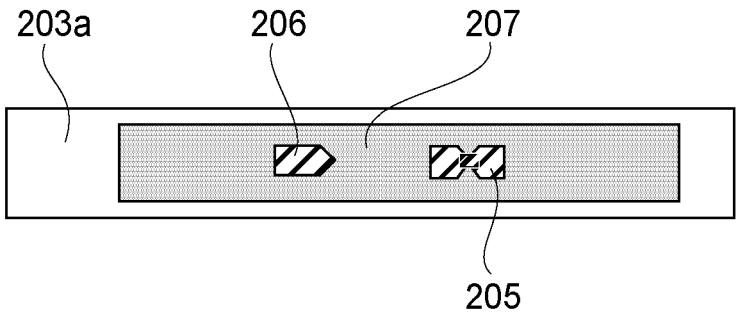
FIG. 12 is a plan view of the combination of the heater substrate, heat conduction layer, thermal fuse, and thermistor in the sixth embodiment of the present invention, and shows the positional relationship among the heater, heat conduction layer, thermal fuse, and thermistor.

Next, another (sixth) embodiment of the present invention is described. FIG. 12 is a drawing for describing the positional relationship among the heater 203, heat conduction layer 207, and thermal fuse 206 of the fixing device C in this embodiment.

In the case of the fixing device C in this embodiment, a single heat conduction layer 207 was placed on the back surface of the substrate 203*a*, and the thermal fuse 206 and thermistor 205 were placed in contact with the heat conduction layer 207. Otherwise, the fixing device C in this embodiment is the same in structure as the one in the first embodiment. Thus, the thermistor 205 detects the temperature of the heater 203 through the heat conduction layer 207. Referring to FIG. 12, the heat conduction layer 207 which is roughly 10 μm in thickness was formed on the back surface of the substrate 203*a* in such a shape and size that the heat conduction layer 207 covers at least the portions of the substrate 203*a*, which correspond in position to the thermal fuse 206 and thermistor 205, one for one; these portions of the substrate 203*a* were coated with Ag paste and fired.

The thermal fuse 206 was attached to the substrate 203*a*, with the above described thermally conductive grease placed between the metallic shell 206*a* of the thermal fuse 206 and the heat conduction layer 207. The thermistor 205 is attached to the substrate 203*a* so that its electrical insulation 205*d* (FIG. 5(*a*)) is placed in contact with the heat conduction layer 207. Further, the area of contact between the heat conduction layer 207 and substrate 203*a* was made greater than the area of contact between the thermistor 205 and heat conduction layer 207.

The fixing device C in this embodiment was subjected to the same runaway test as the one to which the fixing device C in this embodiment was subjected. The length of time it took for the thermal fuse 206 to open was 6.3 seconds, which is the same as the fixing device C in the first embodiment, whereas the length of time it took for the heater 203 (substrate 203*a*) to crack was 13.0 seconds. It seems reasonable to think that this is the proof that the cracking which occurred to the portion of the substrate 203*a*, which corresponds in position to the thermistor 205, when the fixing device C in the first embodiment was subjected to the runaway test, was prevented. That is, this embodiment made it possible to provide a fixing device with an even greater margin in time between the point in time at which the thermal fuse 206 reacts and the point in time at which the heater 203 (substrate 203*a*) cracks.

The elements other than the thermal fuse 206 and thermistor 205, which are to be placed on the back surface of the substrate 203*a*, may be placed on the heat conduction layer 207. In the case where the other elements are placed on the back surface of the substrate 203*a*, the portions of the back surface of the substrate 203*a*, which correspond in position to the thermal fuse 206, thermistor 206, and the other elements, are rendered uniform in temperature.

As described above, in the case of the fixing device C in this embodiment, the metallic shell 206*a* of the thermal fuse 206, and the insulator 205*d* of the thermistor 205, are placed in contact with the heat conduction layer 207, which is placed on the back surface of the substrate 203*a* and is greater in thermal conductivity than the substrate 203*a*. Thus, the heat conduction layer 207 can minimize in severity the phenomenon that as the heater 203 abnormally increases in temperature, not only the portion of the substrate 203*a*, which corresponds in position to the thermal fuse 206, but also, the portion of the substrate 203*a*, which corresponds in position to the thermistor 205, become nonuniform in thermal stress. In other words, this embodiment also can provide effects similar to the effects which the first embodiment does.

Embodiment 7

Figure 13:
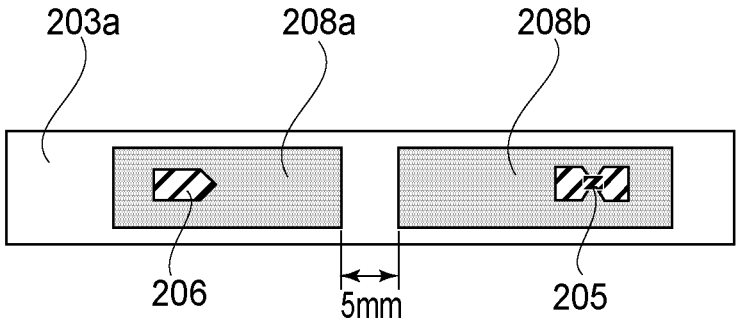
FIG. 13 is a plan view of the combination of the heater, aluminum plate, thermal fuse, and thermistor in the seventh embodiment of the present invention, and shows the positional relationship among the heater, aluminum plate, thermal fuse, and thermistor.

Next, another (seventh) embodiment of the present invention is described. FIG. 13 is a drawing which shows the relationship among the heater 203, aluminum plates 208*a* and 208*b*, thermal fuse 206, and thermistor 205 of the fixing device C in this embodiment.

In the case of the fixing device C in this embodiment, the aluminum plates 208*a* and 208*b* as the first and second thermally conductive layers, respectively, are provided on the back surface of the substrate 203*a*. The thermal fuse 206 was placed in contact with the aluminum plate 208*a*, and the thermistor 205 was placed in contact with the aluminum plate 208*b*. Otherwise, the fixing device C in this embodiment was the same in structure as the one in the first embodiment.

That is, in this embodiment, the thermal fuse 206, which is in connection to the primary circuit of the power supply circuit PS, was placed on the aluminum plate 208*a*, whereas the thermistor 205 which is in connection to the secondary circuit of the power supply circuit PS, was placed on the aluminum plate 208*b*, being thereby separated from each other in terms of electrical connection. In other words, the fixing device C was structured so that there was no electrical conduction between the aluminum plates 208*a* and 208*b*. Thus, even if the heater 203 cracks, the primary current does not flow into the secondary circuit.

The substances which are satisfactory as the material for a thermally conductive member are overwhelmingly such substances as metal, graphite, and the like, which are also electrically conductive. In a case where a component (thermally conductive member) made of such a substance as the abovementioned ones is placed on the back surface of the substrate 203*a*, and the thermal fuse 206 and thermistor 205 are placed on the thermally conductive member, if the heater 203 (203*a*) cracks for some reason or the other, it is possible that the primary current from the commercial outlet will directly flow into the secondary circuit. Therefore, it is reasonable to think that if the heater 203 (substrate 203*a*) cracks, the primary current will flow into the thermistor 205 through the metallic shell 206*a* of the thermal fuse 206, for example.

Further, once the power supply circuit PS goes out of control due to the malfunctioning of the primary circuit, it is possible that the electrical insulator 205*d* (FIG. 5(*a*)) of the thermistor 205 will have been carbonized because of the abnormal temperature increase of the heater 203. In such a case, the insulator 305*d* cannot play the role of insulator, allowing therefore the primary current to directly flow into the thermistor element 205*c* (FIG. 5(*a*)). Therefore, it is possible that the secondary circuit will malfunction. If the secondary circuit malfunctions, the malfunction does not remain in the fixing device C. That is, it spreads to the control panel, main circuit board, etc., making it necessary for various components of the image forming apparatus to be replaced. Thus, the time (labor) and cost for repairing the apparatus becomes substantial. Thus, it is desired that the secondary circuit is prevented, as much as possible, from malfunctioning.

In this embodiment, two aluminum plates 208*a* and 208*b*, with which the thermal fuse 206 and thermistor 205 are placed in contact, respectively, are used as the thermally conductive members. Further, the two aluminum plates 208*a* and 203*b* are fixed to the back surface of the substrate 203*a*, with the presence of a preset distance between the two plates 208*a* and 208*b* in terms of the lengthwise direction. The preset distance between the two aluminum plates 208*a* and 208*b* is 5 mm. This structural arrangement can keep the aluminum plate 208*a*, with which the metallic shell 206*a* of the thermal fuse 206 is placed in contact, separated in terms of electrical connection from the aluminum plate 208*b*, with which the electrical insulator 205*d* of the thermistor 205 is placed in contact.

The fixing device C in this embodiment was subjected to a runaway test similar to the one to which the fixing device C in the first embodiment was subjected. The length of time it took for the thermal fuse 206 to open was 6.3 seconds, which was the same as the length of time it took for the thermal fuse 206 in the first embodiment to open, whereas the length of time it took for the heater 203 (substrate 203*a*) to crack was 13.5 seconds. It is evident from these results that this embodiment can keep the primary and secondary circuits of the power supply circuit PS separated from each other, and also, can ensure that the thermal fuse 206 will react before the heater 203 (substrate 203*a*) cracks as the power supply circuit PS goes out of control.

As described above, in the case of the fixing device C in this embodiment, the two aluminum plates 208*a* and 208*b*, which are separated from each other in terms of electrical connection, are placed on the back surface of the substrate 203*a* of the heater 203. The metallic shell 206*a* of the thermal fuse 206 is placed in contact with the aluminum plate 208*a*, and the electrical insulator 205*d* of the thermistor 205 is placed in contact with the aluminum plate 208*b*. That is, the presence of the two aluminum plates 208*a* and 208*b*, which are separated from each other in terms of electrical connection, can keep the thermal fuse 206 and thermistor 205 separated from each other in terms of electrical connection, and also, minimize in severity the phenomenon that as the heater 203 abnormally increases in temperature, the portion of the substrate 203*a*, which corresponds in position to the thermal fuse 206, becomes nonuniform in thermal stress. In other words, this embodiment enables the thermal fuse 206 and thermistor 205 to operate without short-circuiting, and also, can provide the effects similar to those which the first embodiment can.

The usage of the fixing device C in this embodiment is not limited to the usage as an apparatus for thermally fixing an unfixed toner image on a sheet of recording medium to the sheet. That is, the fixing device C in this embodiment can be used also as an image heating apparatus (device) for heating a temporarily fixed toner image on a sheet of recording medium, to make the toner image glossy.

Embodiment 8

Figure 14:
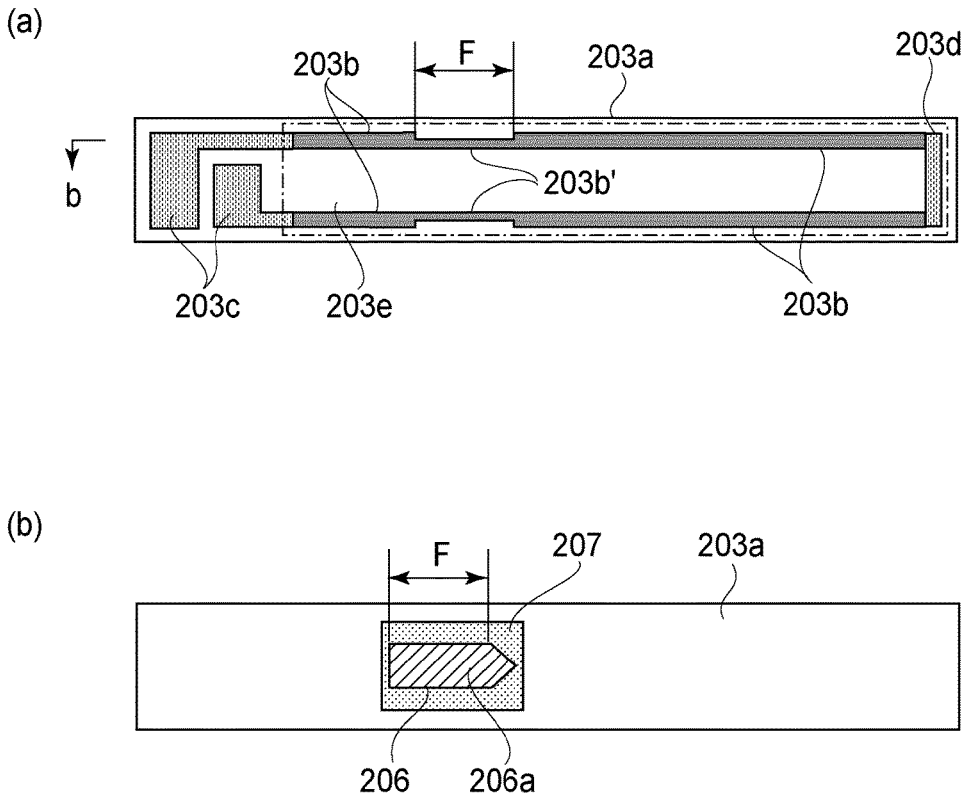
In FIG. 14, (*a*) is a plan view of the heater in the third embodiment of the present invention, as seen from the side where the heat generating resistor is present, and shows the general structure of the heater, and (*b*) is a plan view of the combination of the heater substrate, heat conduction layer, and thermal fuse in the third embodiment, the thermal fuse of which is disposed on the heat conduction layer.

Next, another (eighth) embodiment of the present invention is described. FIG. 14 is a drawing which shows the relationship among the heater 203, heat conduction layer 207, and thermal fuse 206 of the fixing device C in this embodiment. More specifically, FIG. 11(*a*) is a schematic plan view of the heater 203 in this embodiment, as seen from the side of the substrate 203*a*, on which the strips 203*b* of heat generating resistor are present. FIG. 11(*b*) is a schematic plan view of the surface of the substrate 203*a*, on which the fixation film 201 slides, and to which the thermal fuse 206 is attached with the placement of the heat conduction layer 207 between itself and substrate 203*a*.

In the case of the fixing device C in this embodiment, the portion b' of each of the pair of strips 203*b* of heat generating resistor, which corresponds in position to the area F of the substrate 203*a*, which is the portion of the substrate 203*a*, with which the thermal fuse 206 is placed in contact, is made narrower than the rest, and the thermal fuse 206 is attached to the substrate 203*a*, with the placement of heat conduction layer 207 between itself and substrate 203*a*, so that it corresponds in position to the narrow portion b' of the strip 203*b* of heat generating resistor. Thus, it is possible to prevent the problem that while the heater 203 is started up, the portion of the substrate 203*a*, which corresponds in position to the thermal fuse 206, is reduced in temperature by the thermal capacity of the thermal fuse 206. This structural arrangement is effective to prevent the problem that as the power supply circuit PS goes out of control, the heater 203 (substrate 203*a*) cracks.

Referring to FIG. 14(*a*), the portion b' of each strip 203*b* of heat generating resistor, which corresponds in position to the area F of the back surface of the substrate 203*a*, that is, the portion of the back surface of the substrate 203*a*, with which the thermal fuse 206 is placed in contact, is narrow (portion of each strip 203*b* of heat generating resistor, which is outside area F is normal in width). The narrowed portion b' of the strip 203*b* of heat generating resistor is 10 mm in dimension in terms of the lengthwise direction. The dimension of the narrowed portion b' of the strip 203*b* of heat generating resistor in terms of the widthwise direction has been adjusted so that the electrical resistance of the narrow portion b' of the strip 203*b* of heat generating resistor becomes 1.05 times the electrical resistance of the portion of the strip 203*b* of heat generating resistor, which corresponds in position to the other area of the back surface of the substrate 203*a* than the area F.

Referring to FIG. 14(*b*), the portion of the back surface of the substrate 203*a*, which corresponds in position to the thermal fuse 206, is provided with a thermally conductive layer 207, which is roughly 10 μm in thickness and was formed by applying Ag paste to the substrate 203*a* and firing the applied Ag paste. The thermal fuse 206 is attached to the heat conduction layer 207 (substrate 203*a*), with the placement of thermally conductive grease between the thermal fuse 206 and heat conduction layer 207.

The amount of heat which the normal width portion b of the strip 203*b* of heat generating resistor can generate is different from the amount of heat which the narrow portion b' of the strip 203*b* of heat generating resistor can generate. Therefore, as the power supply circuit PS goes out of control, the portions of the substrate 203*a*, which correspond in position to the borderlines between the normal with portion b of the strips 203*b* of heat generating resistor, and the narrow portion b', become greater in thermal stress. Therefore, the heater 203 (substrate 203*a*) is likely to crack at these borderlines. As a means for dealing with this problem that as the power supply circuit PS goes out of control, the heater 203 (substrate 203*a*) cracks, it is effective to widen (lengthen) the heat conduction layer 207 so that the heat conduction layer 207 becomes longer than the dimension of the narrow portion b' of the strip 203*b* of heat generating resistor in terms of the lengthwise direction, and therefore, can conduct the heat which the narrow portion b' generates in the lengthwise direction of the substrate 203*a* through the heat conduction layer 207. In this embodiment, the dimension of the heat conduction layer 207 in terms of the lengthwise direction was 15 mm, which was greater than the dimension of the portion of the substrate 203*a*, which corresponds in position to the narrow portion b' of the strip 203*b* of heat generating resistor.

When the heater 203 of the fixing device C in this embodiment in the image forming apparatus was started up, the portion of the back surface of the substrate 203*a*, which corresponds in position to the thermal fuse 206, was the same in temperature change as the rest of the back surface of the substrate 203*a*. Further, even the toner image on the first sheet P of recording medium did not show image defects such as insufficiency in glossiness.

When the fixing device C in this embodiment was subjected to the same runaway test as the one to which the fixing device C in the first embodiment was subjected, the length of time it took for the thermal fuse 206 to open was 5.8 seconds, whereas the length of time it took for the heater 203 (substrate 203*a*) to crack was 10.0 seconds, which proved that this embodiment provided a sufficient margin in time to prevent the problem that as the power supply circuit PS goes out of control, the heater 203 (substrate 203*a*) cracks.

During the above-described runaway test, the portions of the surface of the substrate 203*a*, which are in the recording medium passage and correspond in position to the thermal fuse 206 and strips 203*b* of heat generating resistor, were measured in temperature by a couple of K thermocouples attached thereto, one for one, as those of the fixing device C in the first embodiment were measured. 10 seconds after the starting of the runaway test, the difference in temperature between the portions of the surfaces of the substrate 203*a*, which correspond in position to the strips 203*c* of heat generating resistor and thermal fuse 206, respectively, was 35° C., and the amount of thermal stress was 95.6 MPa/mm$^2$.

Further, in the case of a fixing device made as a comparative fixing device, the back surface of the substrate 203*a* was not provided with the thermally conductive layer 207 (Ag paste was not coated and fired), and the thermal fuse 206 was attached to the substrate 203*a* with the placement of thermally conductive grease between the thermal fuse 206 and substrate 203*a*. This comparative fixing device was subjected to the same runaway test as the one to which the fixing device C in the first embodiment was subjected. The comparative fixing device was the same in structure as the fixing device C in this embodiment. When the comparative fixing device was subjected to the runaway test, it required 6.0 seconds for the thermal fuse 206 to open, whereas the length of time it took for the heater 203 (substrate 203*a*) to crack was 5.7 seconds. Further, the points of the heater 203 (substrate 203*a*) at which the heater 203 cracked corresponded in position to the lengthwise ends of the narrow portion b' of the strip 203*b* of heat generating resistor.

Further, the difference in temperature between the portions of the surfaces of the substrate 203*a*, which correspond in position to the strips 203*c* of heat generating resistor and thermal fuse 206, respectively, was 65° C., and the amount of thermal stress was 177.4 MPa/mm$^2$, 5.5 second after the starting of the runaway test.

Further, in the case of the comparative fixing device, the back surface of the substrate 203*a* was not provided with the thermally conductive layer 207. Therefore, the end portion 206*a*1 of the metallic shell 206*a* of the thermal fuse 206 was in contact with the substrate 203*a*, and the portions of the substrate 203*a*, which correspond in position to the borderlines between the normal width portion b and narrow portion b' of the strip 203*b*, are subjected to a large amount of thermal stress and also, mechanical stress, which can be thought to be the reason why the heater 203 (substrate 203*a*) cracked.

As described above, in the case of the fixing device C in this embodiment, the portion b' of the strip 203*b* of heat generating resistor, which correspond in position to the area F of the portion F of the substrate 203*a*, that is, the portion of the substrate 203*a*, with which the thermal fuse 206 is placed in contact, was narrowed, and the thermal fuse 206 was attached to the substrate 203*a*, with the placement of the heat conduction layer 207 between the thermal fuse 206 and substrate 203*a*. The presence of this heat conduction layer 207 can minimize the amount of stress to which the portions of the substrate 203*a*, which correspond in position to the narrow portion b' of the strip 203*b* of heat generating resistor, and the thermal fuse 206, are subjected. Thus, this embodiment also can provide the same effects as those which the first embodiment can provide.

While the invention has been described with reference to the structures disclosed herein, it is not confined to the details set forth, and this application is intended to cover such modifications or changes as may come within the purposes of the improvements or the scope of the claims.

INDUSTRIAL APPLICABILITY

According to the present invention, an image heating apparatus which can prevent its heat generating member from cracking when the heat generating member excessively increases in temperature is provided.

The invention claimed is:

1. An image heating apparatus for heating a toner image formed on a recording material, said image heating apparatus comprising:

a fixing member configured to contact the toner image formed on the recording material;

a heater configured to contact said fixing member, said heater including a substrate, a heat generating resistor formed on said substrate, and a protective layer formed on said substrate so as to protect said heat generating resistor;

a heat conduction member configured to contact a surface of said heater opposite to a surface of said heater contacting said fixing member, said heat conduction member having a thermal conductivity higher than that of said substrate; and an electric power shut-off member configured to be operable in response to an abnormal temperature rise of said heater to shut off supply of electric power to said heater, said electric power shut-off member contacting said heat conduction member, wherein a first contact area between said heat conduction member and said heater is larger than a second contact area between said heat conduction member and said electric power shut-off member, the length of the first contact area in a longitudinal direction of said heater being greater than the length of an outline of an external cover of said electric power shut-off member in the longitudinal direction of said heater.

2. The apparatus according to claim 1, further comprising a temperature detecting member contacting said heat conduction member, and configured to detect a temperature of said heater through said heat conduction member, wherein the first contact area is larger than a third contact area between said heat conduction member and said temperature detecting member.

3. The apparatus according to claim 1, further comprising a temperature detecting member configured to detect a temperature of said heater, and a second heat conduction member provided between said temperature detecting member and said substrate and contacting said heater in a non-electrical conduction state with said heat conduction member, wherein a fourth contact area between said second heat conduction member and said heater is larger than a third contact area between said second heat conduction member and said temperature detecting member.

4. The apparatus according to claim 1, further comprising a pressing member cooperating with said fixing member to form a nip for feeding the recording material.

5. The apparatus according to claim 4, wherein said fixing member includes a cylindrical film.

6. The apparatus according to claim 5, wherein said heater contacts an inner surface of said film, and said nip is formed with said pressing member through said film.

7. The apparatus according to claim 4, wherein said heat conduction member has a length sufficient to overlap an area through which a recording material passes, the recording material having a width smaller than a width of the recording material of a maximum width capable of being fed in said apparatus with respect to a direction perpendicular to a feeding direction of the recording material.

8. The apparatus according to claim 1, wherein said electric power shut-off member includes a thermal fuse.

9. The apparatus according to claim 1, wherein said heat conduction member includes a silver metal pasted on said substrate.

10. The apparatus according to claim 1, wherein said heat conduction member includes a metal plate.

11. The apparatus according to claim 1, further comprising a supporting member supporting said heater, said supporting member being made of resin, said supporting member sandwiching said heat conduction member with said heater.

12. The apparatus according to claim 1, wherein said substrate has a thickness larger than that of said heat conduction member.

13. An image heating apparatus for heating a toner image formed on a recording material, said image heating apparatus comprising:

a fixing member configured to contact the toner image formed on the recording material;

a heater configured to contact said fixing member, said heater including a substrate, a heat generating resistor formed on said substrate, and a protective layer formed on said substrate so as to protect said heat generating resistor;

an electric power shut-off member configured to be operable in response to an abnormal temperature rise of said heater to shut off supply of electric power to said heater; and a heat conduction member configured to contact a surface of said heater opposite to a surface of said heater contacting said fixing member, said heat conduction member having a thermal conductivity higher than that of said substrate and provided as a component separate from said electric power shut-off member, wherein said electric power shut-off member contacts said heat conduction member, and a first contact area between said heat conduction member and said heater is larger than a second contact area between said heat conduction member and said electric power shut-off member.

14. The apparatus according to claim 13, further comprising a supporting member supporting said heater, said supporting member being made of resin, said supporting member sandwiching said heat conduction member with said heater.

15. The apparatus according to claim 13, further comprising a temperature detecting member contacting said heat conduction member, and configured to detect a temperature of said heater through said heat conduction member, wherein the first contact area is larger than a third contact area between said heat conduction member and said temperature detecting member.

16. The apparatus according to claim 13, further comprising a temperature detecting member configured to detect a temperature of said heater, and a second heat conduction member provided between said temperature detecting member and said heater and contacting said heater in a non-electrical conduction state with said heat conduction member, wherein a fourth contact area between said second heat conduction member and said heater is larger than a third contact area between said second heat conduction member and said temperature detecting member.

17. The apparatus according to claim 13, wherein said substrate has a thickness larger than that of said heat conduction member.

18. An image heating apparatus for heating a toner image formed on a recording material, said image heating apparatus comprising:

a fixing member configured to contact the toner image formed on the recording material;

a heater configured to contact said fixing member, said heater including a substrate, a heat generating resistor formed on said substrate, and a protective layer formed on said substrate so as to protect said heat generating resistor;

a heat conduction member configured to contact a surface of said heater opposite to a surface of said heater contacting said fixing member, said heat conduction member having a thermal conductivity higher than that of said substrate; and a thermal fuse configured to be operable in response to an abnormal temperature rise of said heater to shut off supply of electric power to said heater, said thermal fuse contacting said heat conduction member, wherein a first contact area between said heat conduction member and said heater is larger than a second contact area between said heat conduction member and said thermal fuse.

19. The apparatus according to claim 18, wherein said thermal fuse has a cylindrical portion contacting said heat conduction member.

20. The apparatus according to claim 18, further comprising a supporting member supporting said heater, said supporting member being made of resin, said supporting member sandwiching said heat conduction member with said heater.

21. The apparatus according to claim 18, further comprising a temperature detecting member configured to detect a temperature of said heater, and a second heat conduction member provided between said temperature detecting member and said heater and contacting said heater in a non-electrical conduction state with said heat conduction member, wherein a fourth contact area between said second heat conduction member and said heater is larger than a third contact area between said second heat conduction member and said temperature detecting member.

22. The apparatus according to claim 18, wherein said substrate has a thickness larger than that of said heat conduction member.

23. An image heating apparatus for heating a toner image formed on a recording material, said image heating apparatus comprising:

a fixing member configured to contact the toner image formed on the recording material;

a heater configured to contact said fixing member, said heater including a substrate, a heat generating resistor formed on said substrate, and a protective layer formed on said substrate so as to protect said heat generating resistor;

a heat conduction member configured to contact a surface of said heater opposite to a surface of said heater contacting said fixing member, said heat conduction member having a thermal conductivity higher than that of said substrate; and a thermal switch including a heat sensing portion in which a bimetal is disposed, configured to be operable in response to an abnormal temperature rise of said heater to shut off supply of electric power to said heater, the heat sensing portion of said thermal switch contacting said heat conduction member, wherein a first contact area between said heat conduction member and said heater is larger than a second contact area between said heat conduction member and the heat sensing portion of said thermal switch.

24. The apparatus according to claim 23, further comprising a supporting member supporting said heater, said supporting member being made of resin, said supporting member sandwiching said heat conduction member with said heater.

25. The apparatus according to claim 23, further comprising a temperature detecting member contacting said heat conduction member, and configured to detect a temperature of said heater through said heat conduction member, wherein the first contact area is larger than a third contact area between said heat conduction member and said temperature detecting member.

26. The apparatus according to claim 23, further comprising a temperature detecting member configured to detect a temperature of said heater, and a second heat conduction member provided between said temperature detecting member and said heater and contacting said heater in a non-electrical conduction state with said heat conduction member, wherein a fourth contact area between said second heat conduction member and said heater is larger than a third contact area between said second heat conduction member and said temperature detecting member.

27. The apparatus according to claim 23, wherein said substrate has a thickness larger than that of said heat conduction member.

28. An image heating apparatus for heating a toner image formed on a recording material, said image heating apparatus comprising:

a fixing member configured to contact the toner image formed on the recording material;

a heater configured to contact said fixing member, said heater including a substrate, and a heat generating resistor formed on said substrate;

a heat conduction member configured to contact a surface of said heater opposite to a surface of said heater contacting said fixing member, said heat conduction member having a thermal conductivity higher than that of said substrate;

a thermal switch including a heat sensing portion in which a bimetal is disposed, configured to be operable in response to an abnormal temperature rise of said heater to shut off supply of electric power to said heater; and a spacer sandwiched between the heat sensing portion of said thermal switch and said heat conduction member so as to be in contact with both the heat sensing portion of said thermal switch and said heat conduction member, wherein a first contact area between said heat conduction member and said heater is larger than a second contact area between said heat conduction member and said spacer.

29. The apparatus according to claim 28, further comprising a temperature detecting member contacting said heat conduction member, and configured to detect a temperature of said heater through said heat conduction member, wherein the first contact area is larger than a third contact area between said heat conduction member and said temperature detecting member.

30. The apparatus according to claim 28, wherein said spacer is a resin member which has a thermal conductivity lower than that of said substrate.

31. An image heating apparatus for heating a toner image formed on a recording material, said image heating apparatus comprising:

a fixing member configured to contact the toner image formed on the recording material;

a heater configured to contact said fixing member, said heater including a substrate, and a heat generating resistor formed on said substrate;

an electric power shut-off member configured to be operable in response to an abnormal temperature rise of said heater to shut off supply of electric power to said heater;

a heat conduction member configured to contact a surface of said heater opposite to a surface of said heater contacting said fixing member, said heat conduction member having a thermal conductivity higher than that of said substrate and provided as a component separate from said electric power shut-off member; and a spacer sandwiched between said electric power shut-off member and said heat conduction member so as to be in contact with both said electric power shut-off member and said heat conduction member, wherein a first contact area between said heat conduction member and said heater is larger than a second contact area between said heat conduction member and said spacer.

32. An image heating apparatus for heating a toner image formed on a recording material, said image heating apparatus comprising:

a fixing member configured to contact the toner image formed on the recording material;

a heater configured to contact said fixing member, said heater including a substrate, a heat generating resistor formed on said substrate, and a protective layer formed on said substrate so as to protect said heat generating resistor;

an electric power shut-off member configured to be operable in response to an abnormal temperature rise of said heater to shut off supply of electric power to said heater; and a heat conduction member configured to contact a surface of said heater opposite to a surface of said heater contacting said fixing member, said heat conduction member having a thermal conductivity higher than that of said substrate, wherein said electric power shut-off member contacts said heat conduction member, and a first contact area between said heat conduction member and said heater is larger than a second contact area between said heat conduction member and said electric power shut-off member.

33. An image heating apparatus for heating a toner image formed on a recording material, said image heating apparatus comprising:

a fixing member configured to contact the toner image formed on the recording material;

a heater configured to contact said fixing member, said heater including a substrate and a heat generating resistor formed on said substrate;

an electric power shut-off member configured to be operable in response to an abnormal temperature rise of said heater to shut off supply of electric power to said heater; and a heat conduction member configured to contact a surface of said heater opposite to a surface of said heater contacting said fixing member, said heat conduction member having a thermal conductivity higher than that of said substrate and provided as a component separate from said electric power shut-off member, wherein said electric power shut-off member contacts said heat conduction member, and a first contact area between said heat conduction member and said heater is larger than a second contact area between said heat conduction member and said electric power shut-off member.

* * * * *